US009285761B2

(12) United States Patent
Haruyama

(10) Patent No.: US 9,285,761 B2
(45) Date of Patent: Mar. 15, 2016

(54) COVER OPENING AND CLOSING MECHANISM AND IMAGE FORMING APPARATUS

(71) Applicant: Oki Data Corporation, Tokyo (JP)

(72) Inventor: Masahiro Haruyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/523,406

(22) Filed: Oct. 24, 2014

(65) Prior Publication Data

US 2015/0113879 A1 Apr. 30, 2015

(30) Foreign Application Priority Data

Oct. 25, 2013 (JP) ..... 2013-222402

(51) Int. Cl.
*G03G 21/00* (2006.01)
*G03G 21/16* (2006.01)

(52) U.S. Cl.
CPC ..... *G03G 21/1633* (2013.01)

(58) Field of Classification Search
CPC ..... G03G 21/1633
USPC ..... 399/124
See application file for complete search history.

(56) References Cited

U.S. PATENT DOCUMENTS

| | | | | |
|---|---|---|---|---|
| 2009/0070957 | A1* | 3/2009 | Shiba | 16/223 |
| 2009/0175648 | A1* | 7/2009 | Tsuchiya | 399/107 |
| 2010/0003050 | A1* | 1/2010 | Minaminaka | 399/114 |
| 2013/0011174 | A1* | 1/2013 | Lee et al. | 399/381 |
| 2014/0027974 | A1* | 1/2014 | Fukunaga et al. | 271/225 |

FOREIGN PATENT DOCUMENTS

JP 2011-144005 A 7/2011

* cited by examiner

*Primary Examiner* — David Gray
*Assistant Examiner* — Tyler Hardman
(74) *Attorney, Agent, or Firm* — Muncy, Geissler, Olds & Lowe, P.C.

(57) ABSTRACT

A cover opening and closing mechanism includes a first cover member having a first sheet placing surface and a second cover member having a second sheet placing surface. The first cover member has a first engagement part at a distal end of the first sheet placing surface, the second cover member has a second engagement part at a distal end of the second sheet placing surface so that the first sheet placing surface is flush with the second sheet placing surface. During a process in which the first cover member swings in a close direction, a first contact part of the first cover member, which is other than the first sheet placing surface, contacts to a second contact part of the second cover member, which is other than the second sheet placing surface, before the first engagement part contacts to the second engagement part.

20 Claims, 23 Drawing Sheets

*Fig. 10*
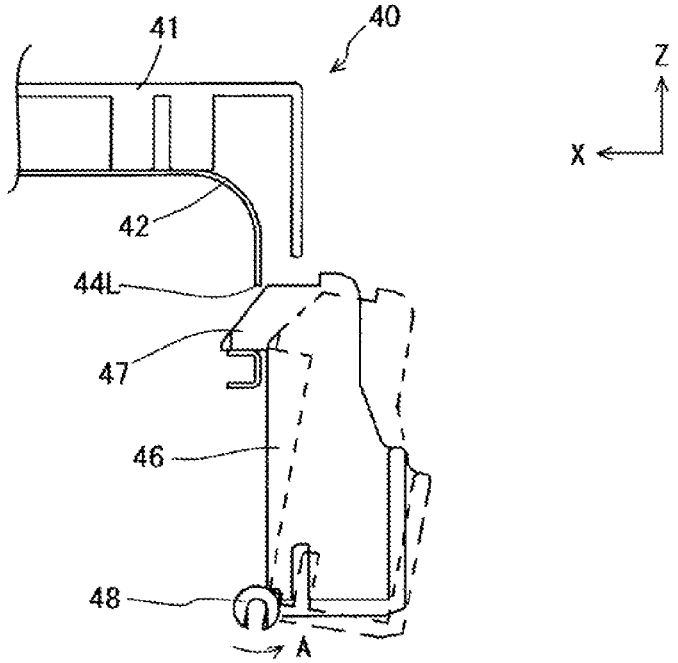
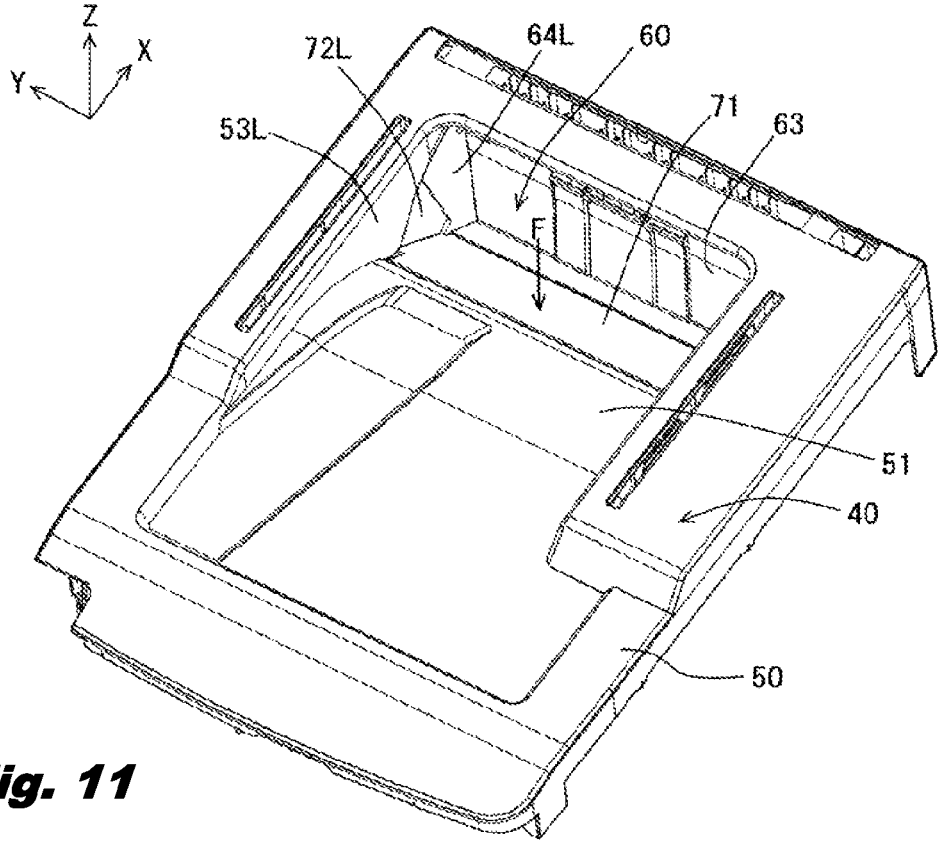
*Fig. 11*

COVER OPENING AND CLOSING MECHANISM AND IMAGE FORMING APPARATUS

CROSS REFERENCE

The present application is related to, claims priority from and incorporates by reference Japanese Patent Application No. 2013-222402, filed on Oct. 25, 2013.

TECHNICAL FIELD

The present invention relates to a cover opening and closing mechanism that is provided with a plurality of external covers and the like, and further relates to an image forming apparatus such as a copying machine, a printer or a facsimile that is provided with the cover opening and closing mechanism.

BACKGROUND

Conventionally, an image forming apparatus, such as a copying machine, a printer or a facsimile, that uses an electrophotographic method is provided with a photosensitive drum as an image carrier, a charging device that charges the photosensitive drum to a predetermined polarity and potential, an exposure unit that forms an electrostatic latent image on the charged photosensitive drum, a development unit that develops the electrostatic latent image as a toner image using a toner, a transfer unit that transfers the toner image to a transfer material such as a sheet, a fuser unit that fuses the toner image on the transfer material, and the like. Further, in order to allow paper jam release, insertion and removal of each unit, and the like to be easily performed, the image forming apparatus is configured in such a manner that a plurality of external covers are mounted rotatable about respective supporting point parts and interior of the image forming apparatus can be accessed from each direction (for example, see Patent Document 1).

[Patent Document 1] Japanese Patent Laid-Open Publication No. 2011-144005 (page 7, FIG. 3).

However, in an image forming apparatus having the above-described configuration, since the respective external covers rotate about the respective supporting point parts, when the respective covers are closed, it is difficult to ensure rigidity that prevents a gap due to an external force from occurring in a joining portion between the external covers and to maintain a good appearance.

The present invention includes a first cover member that swings between open and close positions about a first rotation point, and a second cover member that swings about a second rotation point in conjunction with opening and closing of the first cover member. The first cover member has a first contact part that is in contact with the second cover member and a first engagement part that engages with a second engagement part of the second cover member. In a process in which the first cover member rotates from an open position to a close position, after the first contact part and the second cover member become in contact with each other, the first engagement part engages with the second engagement part.

According to the present invention, opening and closing of the first and second cover members are performed in conjunction with each other, and at a stage where the first cover member is closed, rigidity of a joining portion of the respective cover members can be ensured.

BRIEF DESCRIPTION OF THE DRAWINGS

FIG. 10 is for describing a lock mechanism of the top cover unit that is due to an opening part and a lock bar provided on the front cover.

FIG. 11 illustrates a state in which the ejection cover unit is arranged at a predetermined position of the image forming apparatus and the top cover is locked at a close position by the lock mechanism, in the first embodiment.

DETAILED DESCRIPTION OF EMBODIMENTS

First Embodiment

Figure 1:
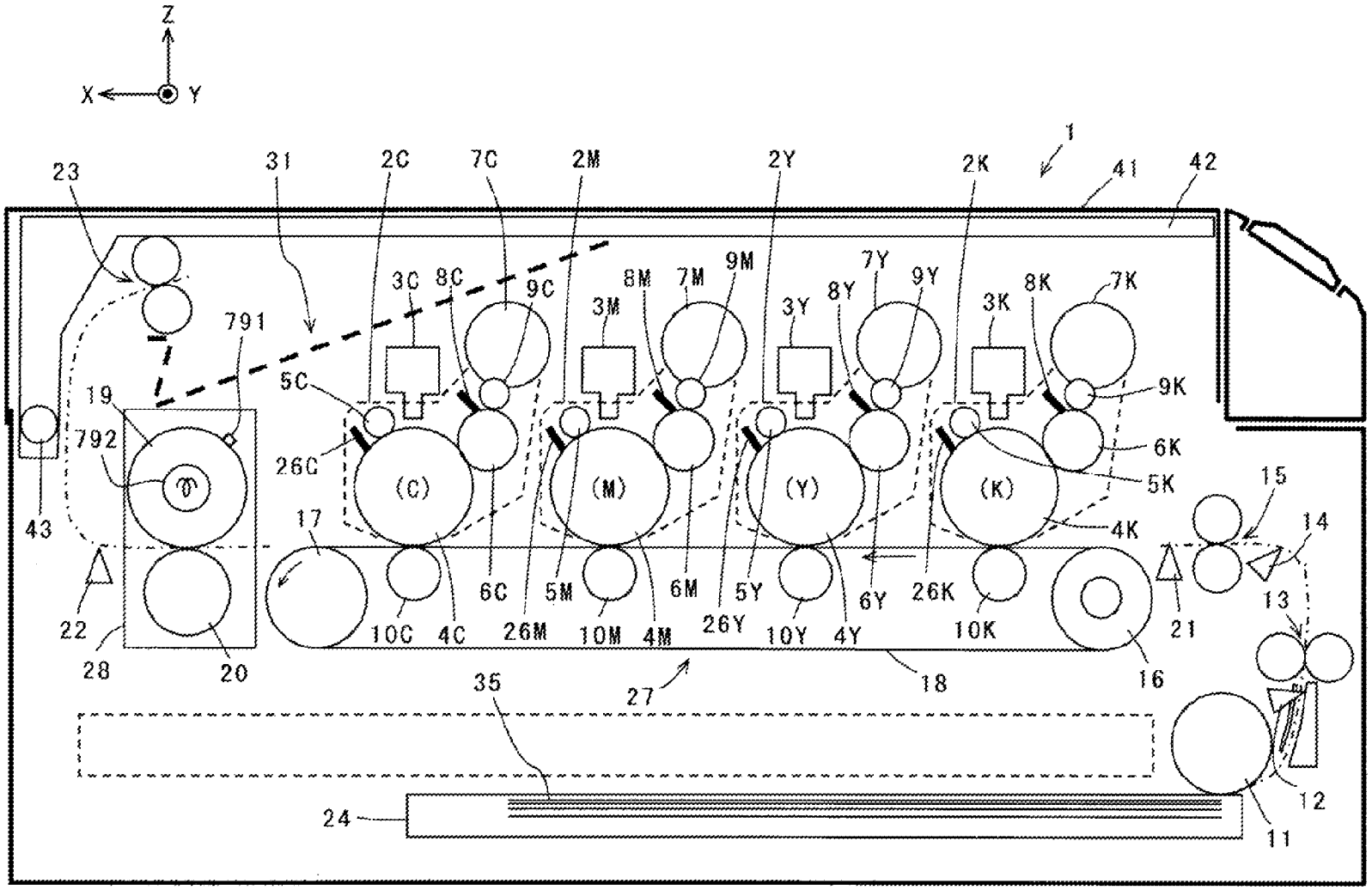
FIG. 1 illustrates a schematic configuration diagram for describing a main part configuration of an image forming apparatus of a first embodiment that is provided with a cover opening and closing mechanism of the present invention.

FIG. 1 illustrates a schematic configuration diagram for describing a main part configuration of an image forming apparatus 1 of a first embodiment that is provided with a cover opening and closing mechanism of the present invention.

As illustrated in FIG. 1, the image forming apparatus 1 is internally provided with: four large units, that is, image forming units 2K, 2Y, 2M, 2C (which may be simply referred to as the image forming units 2 when it is not necessary to particularly distinguish between them) that respectively print black (K), yellow (Y), magenta (M) and cyan (C) images; transfer rollers 10K, 10Y, 10M, 10C (which may be simply referred to as the transfer rollers 10 when it is not necessary to particularly distinguish between them) that respectively oppose the image forming units 2K, 2Y, 2M, 2C; a transfer unit 27 that includes a carrying belt 18, a belt driven roller 16 and a belt drive roller 17, the carrying belt 18 carrying a recording sheet 35 in an endless manner; a sheet cassette 24 for placing therein a plurality of the recording sheets 35 and sequentially feeding out the recording sheets; a sheet feeding roller 11 for separating and feeding out one by one the recording sheets 35 from the sheet cassette 24 by simultaneously using a separation tongue piece and the like; a first carrying roller pair 13 and a first entrance sensor 12 thereof; a second carrying roller pair 15 and a second entrance sensor 14 thereof; a writing sensor 21; a fuser unit 28 that includes a fuser roller 19 that internally has a heating element such as a halogen lamp and fuses developer onto the recording sheet 35 by applying heat and pressure to the recording sheet 35, and a fuser backup roller 20; an ejection sensor 22; an ejection roller pair 23 that ejects the recording sheet 35 after fusion; and an ejection tray 31 on which the recording sheets 35 that are ejected by the ejection roller pair are stacked.

The image forming units 2K, 2Y, 2M, 2C are respectively configured by LED heads 3K, 3Y, 3M, 3C (which may be simply referred to as the LED heads 3 when it is not necessary to particularly distinguish between them), photosensitive drums 4K, 4Y, 4M, 4C (which may be simply referred to as the photosensitive drums 4 when it is not necessary to particularly distinguish between them), charging rollers 5K, 5Y, 5M, 5C (which may be simply referred to as the charging rollers 5 when it is not necessary to particularly distinguish between them), development rollers 6K, 6Y, 6M, 6C (which may be simply referred to as the development rollers 6 when it is not necessary to particularly distinguish between them), toner tanks 7K, 7Y, 7M, 7C, development blades 8K, 8Y, 8M, 8C, and toner supply sponge rollers 9K, 9Y, 9M, 9C.

As will be described later, a top cover 41 (or first cover member) covering an internal configuration is arranged on an upper portion of the image forming apparatus 1. The top cover 41 is fixedly held by an inner plate 42, which is rotatably held by a supporting point part 43 (first rotation point) on an apparatus body, and allows the apparatus to be opened and closed from above to replace an internal component and the like. As described above, with respect to movable or removable configuration elements such as the top cover 41, a portion of the image forming apparatus 1 excluding those movable or removable configuration elements may be referred to as an image forming apparatus body.

Further, although not illustrated in FIG. 1, motors for rotating various rollers, rollers on carrying paths that are laid at a distance equal to or less than a minimum recording sheet interval, a solenoid for carrying path switching, and the like are provided. In particular, as the motors, as will be described later in description of FIG. 2, a sheet feeding motor 811 for mainly rotating the sheet feeding roller 11, a carrying motor 812 for rotating the carrying roller pairs 13, 15, a carrying belt motor 801 for rotating the belt drive roller 17, a fuser motor 793 for rotating the fuser roller 19, the fuser backup roller 20 and the ejection roller pair 23, and a K-ID motor 781, a Y-ID motor 782, an M-ID motor 783 and a C-ID motor 784 for respectively independently driving the image forming units 2K, 2Y, 2M, 2C are provided.

With respect to X, Y and Z axes in FIG. 1, the X-axis is taken in a carrying direction when the recording sheet 35 passes through the image forming units 2K, 2Y, 2M, 2C; the Y-axis is taken in a rotation direction of the photosensitive drums 4K, 4Y, 4M, 4C (to be described later); and the Z-axis is taken in a direction orthogonal to the X and Y axes. Further, when the X, Y and Z axes are illustrated in other drawings (to be described later), the directions of these axes indicate common directions. That is, the X, Y and Z axes in each of the drawings indicate arrangement directions when illustrated portions in the each of the drawings configure the image forming apparatus 1 illustrated in FIG. 1. Here, it is assumed that the image forming apparatus 1 is arranged in such a manner that the Z axis is along a substantially vertical direction.

Figure 2:
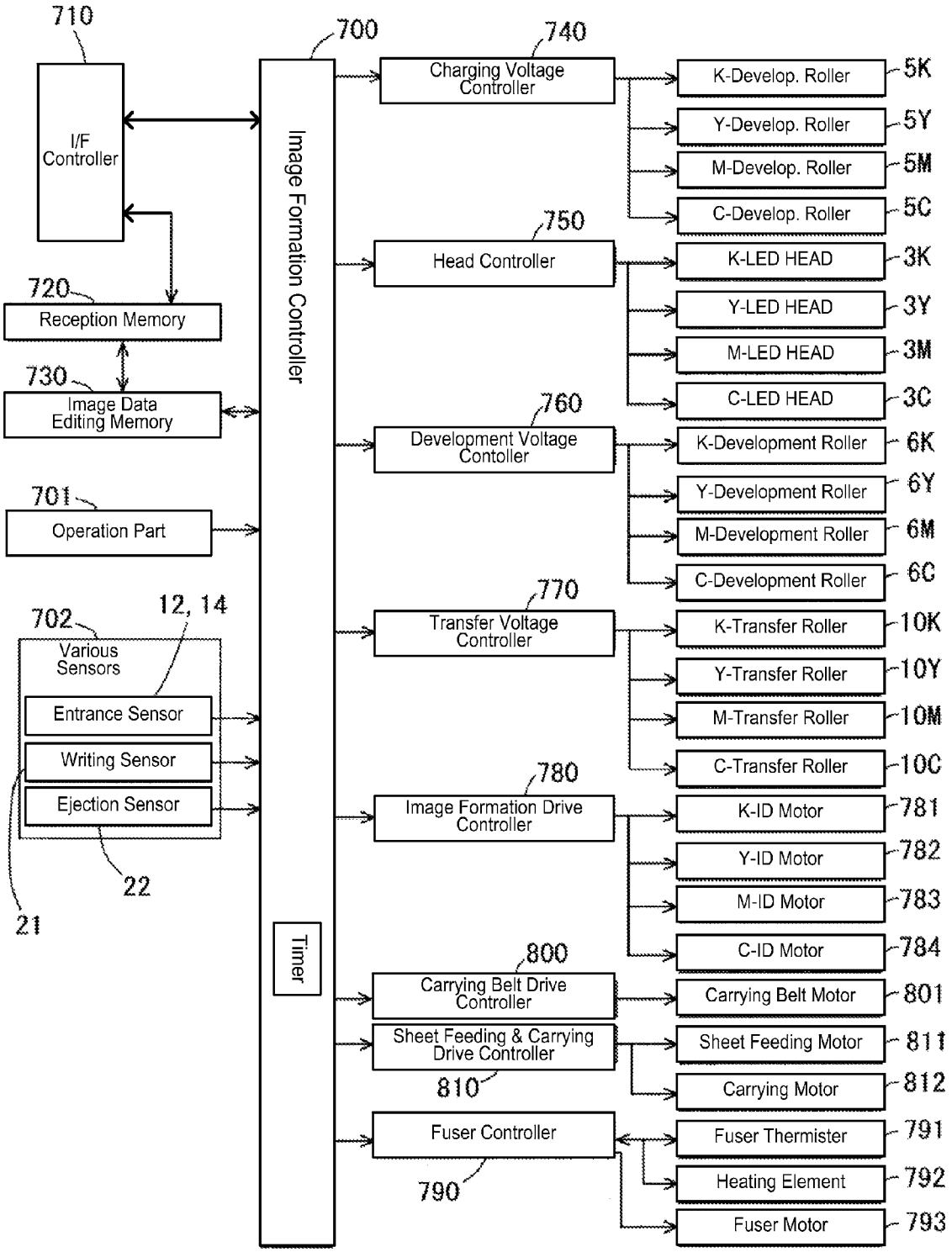
FIG. 2 illustrates a block diagram illustrating a main part configuration of a control system that controls main part operation of the image forming apparatus.

FIG. 2 illustrates a block diagram illustrating a main part configuration of a control system that controls main part operation of the image forming apparatus 1.

In FIG. 2, an image formation controller 700 is configured by a microprocessor, a ROM, a RAM, an input and output port, a counter, a timer and the like, and receives print data and a control command from a host device to perform sequence control of a whole printer part and to perform a print operation. An I/F controller 710 transmits printer information to the host device, and analyzes a command input from the host device and processes data received from the host device. A reception memory 720 stores data received from the host device for each color based on control of the I/F controller 710. An operation part 701 is provided with an LED for indicating a state of the image forming apparatus 1 and a switch for providing an instruction from a user to the image formation controller 700.

Various sensors 702 include a plurality of sensors (the first entrance sensor 12, the second entrance sensor 14, the writing sensor 21, the ejection sensor 22, and the like) for detecting a carrying position of the recording sheet 35. Outputs of the respective sensors are input to the image formation controller 700. An image data editing memory 730 is a memory for editing as image data the print data input via the I/F controller 710 from the host device, that is, for receiving the print data that is temporarily stored in the reception memory 720 and editing the printed data into image data for transmitting to the LED heads 3 (FIG. 1), and storing the edited image data.

A charging voltage controller 740 performs control for charging surfaces of the photosensitive drums 4 by applying voltages to the charging rollers 5 in the image forming units 2 (FIG. 1) according to an instruction from the image formation controller 700. The charging voltage controller 740 divides control tasks according to the respective colors and has a K-charging voltage controller, a Y-charging voltage controller, an M-charging voltage controller and a C-charging voltage controller, which respectively control voltages applied to the K-charging roller 5K, the Y-charging roller 5Y, the M-charging roller 5M and the C-charging roller 5C.

A head controller 750 performs control for causing the LED heads 3 (FIG. 1) to irradiate the charged surfaces of the photosensitive drums 4 with light to expose the surfaces according to the image data stored in the image data editing memory 730. The head controller 750 divides control tasks according to the respective colors and has a K-head controller, a Y-head controller, an M-head controller and a C-head controller, which respectively perform controls for transmitting the image data at predetermined timings to the K-LED head 3K, the Y-LED head 3Y, the M-LED head 3M and the C-LED head 3C.

A development voltage controller 760 performs control for applying voltages to the development rollers 6 in the image forming units 2 for attaching toners to electrostatic latent images that are generated by the LED heads 3 on the surfaces of the photosensitive drums 4 (FIG. 1). For this reason, the development voltage controller 760 has a K-development voltage controller, a Y-development voltage controller, an M-development voltage controller and a C-development voltage controller, which respectively control voltages applied to the K-development roller 6K, the Y-development roller 6Y, the M-development roller 6M and the C-development roller 6C.

A transfer voltage controller 770 performs control for receiving an instruction from the image formation controller 700 to apply voltages to the transfer rollers 10 (FIG. 1) for transferring toner images generated on the surfaces of the photosensitive drums 4 (FIG. 1) to the recording sheet 35 that is a recording medium. For this reason, the transfer voltage controller 770 has a K-transfer voltage controller, a Y-transfer voltage controller, an M-transfer voltage controller and an C-transfer voltage controller, which respectively control voltages applied to the K-transfer roller 10K, the Y-transfer roller 10Y, the M-transfer roller 10M and the C-transfer roller 10C and sequentially superimpose and transfer the respective toner images that are generated on the surfaces of the photosensitive drums 4 to the recording sheet 35.

An image formation drive controller 780 performs control for receiving an instruction from the image formation controller 700 to drive the photosensitive drums 4, the charging rollers 5 and the development rollers 6 that are provided in the image forming units 2 (FIG. 1). For this reason, the image formation drive controller 780 has a K-ID motor controller, a Y-ID motor controller, an M-ID motor controller and a C-ID motor controller, which respectively drive and control the K-ID motor 781, the Y-ID motor 782, the M-ID motor 783 and the C-ID motor 784 of the respective image forming units.

A fuser controller 790 is a controller for fusing a toner image that has been transferred to the recording sheet 35, receives an instruction from the image formation controller 700 and a detection temperature from a fuser thermistor 791 that is for measuring a predetermined temperature of the fuser unit 28 (FIG. 1), and controls fusing temperature by turning ON and OFF voltage application to the heating element 792 (see FIG. 1) that is built in the fuser unit 28. Further, at a stage where temperature of the fuser unit 28 has risen to the predetermined temperature, the fuser controller 790 rotationally drives and controls the fuser motor 793 for rotating the fuser roller 19, the fuser backup roller 20 and the ejection roller pair 23.

A carrying belt drive controller 800 rotationally controls, according to an instruction from the image formation controller 700, the carrying belt motor 801 that rotates the belt drive roller 17 that drives the carrying belt 18 of the transfer unit 27 (FIG. 1). A sheet feeding and carrying drive controller 810 rotationally drives and controls, according to an instruction from the image formation controller 700, the sheet feeding motor 811 for rotating the sheet feeding roller 11 (FIG. 1) that feeds the recording sheet 35 and the carrying motor 812 for rotating the first carrying roller pair 13 and the second carrying roller pair 15 that carry the recording sheet 35.

A print operation of the image forming apparatus 1 in the above-described configuration is described next.

The image formation controller 700 illustrated in FIG. 2 receives via the I/F controller 710 a control command and print data that are transmitted from the host device and, upon receiving a print instruction from the host device, instructs the sheet feeding and carrying drive controller 810 about a predetermined carrying speed and causes the sheet feeding roller 11 illustrated in FIG. 1 to rotate to feed out one sheet of the recording sheet 35 from the sheet cassette 24 and to carry the recording sheet 35 to the first carrying roller pair 13.

The first entrance sensor 12 in the middle of the way is provided for such a purpose that whether or not the sheet feeding roller 11 has normally performed sheet feeding is detected and, when the sheet feeding roller 11 has not normally performed the sheet feeding, the sheet feeding operation is performed again; and for such a purpose that, after a leading edge position of the recording sheet 35 is detected, by controlling a driving timing of the first carrying roller pair 13, the leading edge of the recording sheet 35 is butted against the first carrying roller pair 13 to eliminate a skew of the recording sheet 35.

Thereafter, the recording sheet 35 that has been carried to the first carrying roller pair 13 is carried by the second carrying roller pair 15 to the image forming unit 2K. The image forming units 2K, 2Y, 2M, 2C start rotation of the rollers at substantially the same time as the start of the sheet feeding. At this time, negative voltages (about −1000 V), which the image formation controller 700 instructs the charging voltage controller 740 to apply, are applied to the charging rollers 5K, 5Y, 5M, 5C, and the surfaces of the photosensitive drums 4K, 4Y, 4M, 4C are charged. Toners that are used in printing are supplied from the toner tanks 7K, 7Y, 7M, 7C via the sponge rollers 9K, 9Y, 9M, 9C to the development rollers 6K, 6Y, 6M, 6C, and the toners on the development rollers 6K, 6Y, 6M, 6C are formed into thin layers by the development blades 8K, 8Y, 8M, 8C and are frictionally charged.

Further, the belt drive roller 17 rotates at the same time as the start of the rotation of the photosensitive drums 4K, 4Y, 4M, 4C, and the carrying belt 18 moves at a speed same as a circumferential speed of each of the photosensitive drums 4. The recording sheet 35 is further carried by the second carrying roller pair 15 and the writing sensor 21 is turned on. After a predetermined period of time has elapsed since the leading edge of the recording sheet 35 is detected here, the LED head 3K starts exposure to form an electrostatic latent image on the photosensitive drum 4K.

A toner image according to the electrostatic latent image that is formed here is formed on the photosensitive drum 4K by the development roller 6K. At the time when the recording sheet 35 reaches between the photosensitive drum 4K and the transfer roller 10K, a positive voltage (about 3000 V) is applied to the transfer roller 10K, the toner image on the photosensitive drum 4K is attracted to the recording sheet 35 side, and transfer to the recording sheet 35 is performed.

The image forming units 2Y-2C of the other colors also sequentially similarly superimpose and transfer toner images of the respective colors. The recording sheet 35 to which the toner images of the respective colors are transferred is heated and pressed between the fuser roller 19 and the fuser backup roller 20, and fusion of the transferred toner images to the recording sheet 35 is performed. After the fusion, after the leading edge of the recording sheet 35 turns on the ejection sensor 22 that is for monitoring heater jamming and for detecting a medium length after fusion, the recording sheet 35 is ejected by the ejection roller pair 23 and is placed in the ejection tray 31.

(Configuration of Cover Opening and Closing Mechanism)

Next, a cover opening and closing mechanism of the image forming apparatus 1 according to the present invention is described below.

Figure 3:
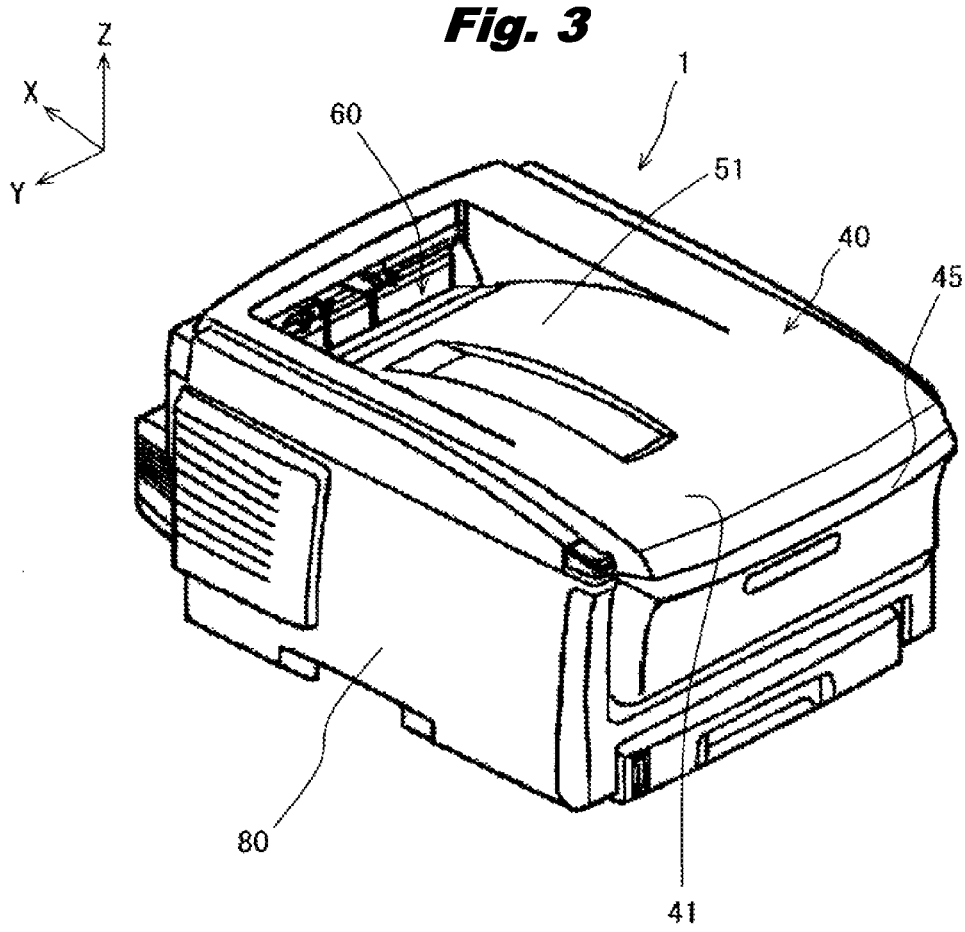
FIG. 3 illustrates an external perspective view of the image forming apparatus of the first embodiment.
Figure 4:
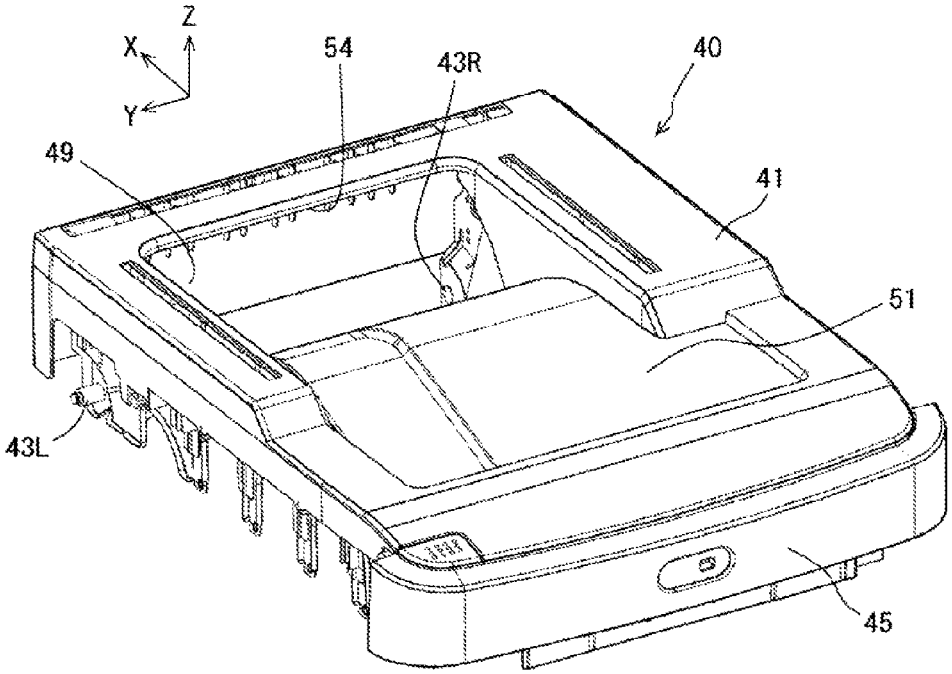
FIG. 4 illustrates an external perspective view of a top cover unit when the top cover unit is locked to a front unit, in the first embodiment.
Figure 5:
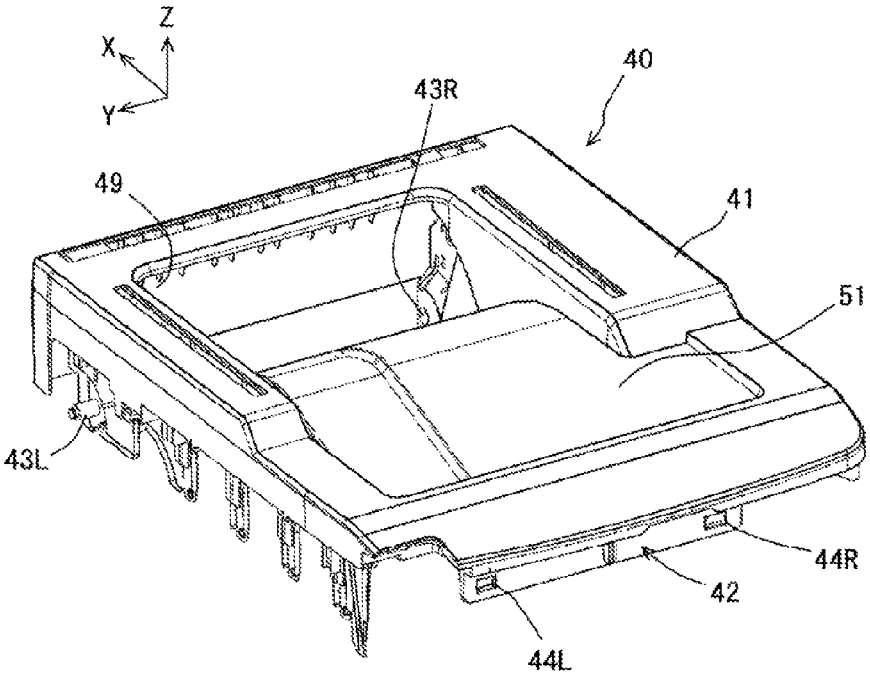
FIG. 5 illustrates an external perspective view of the top cover unit of the first embodiment.
Figure 6:
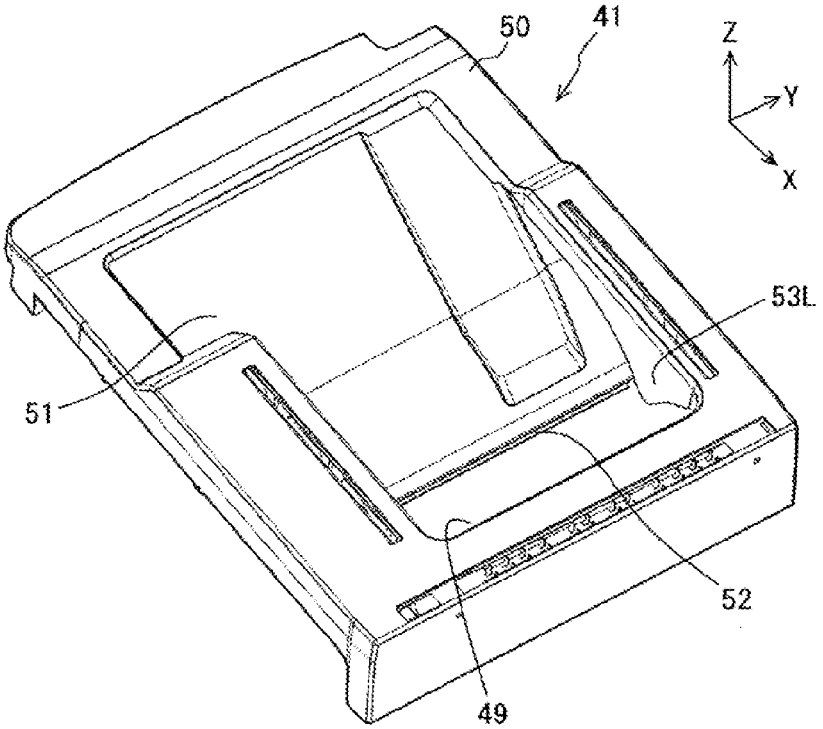
FIG. 6 illustrates an external perspective view of a top cover of the first embodiment.
Figure 7:
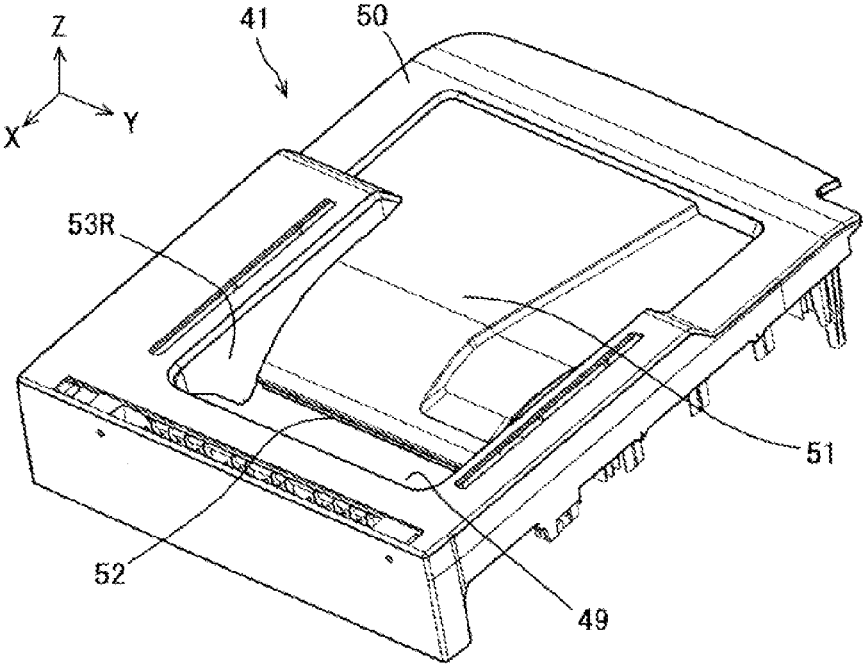
FIG. 7 illustrates an external perspective view of the top cover illustrated in FIG. 6, viewed from another angle.
Figure 8:
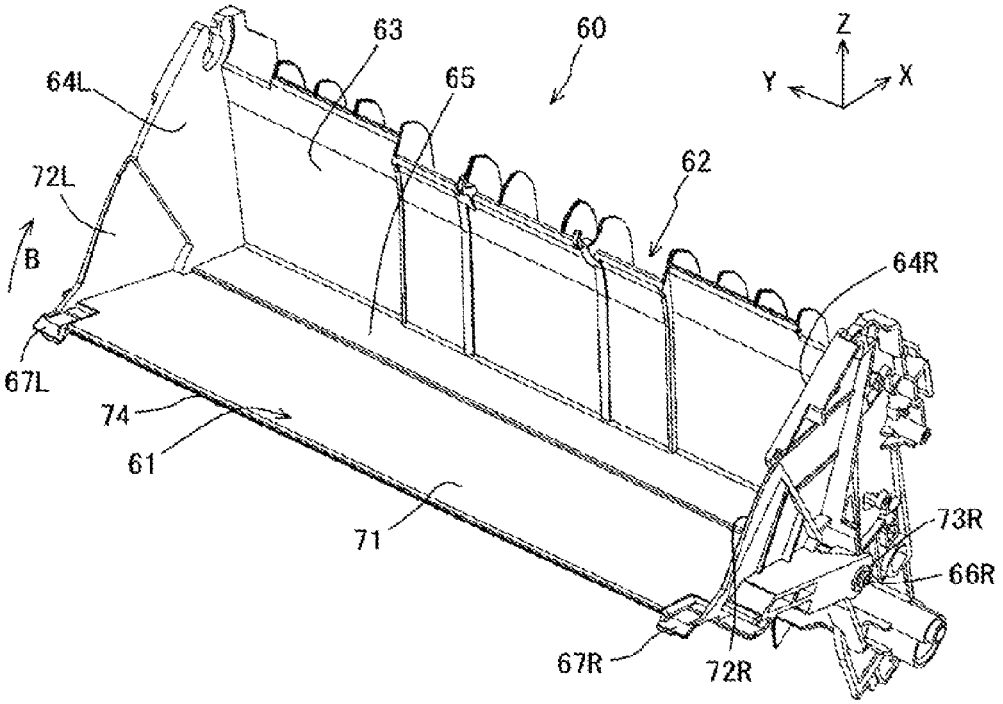
FIG. 8 illustrates an external perspective view of an ejection cover unit of the first embodiment.
Figure 9:
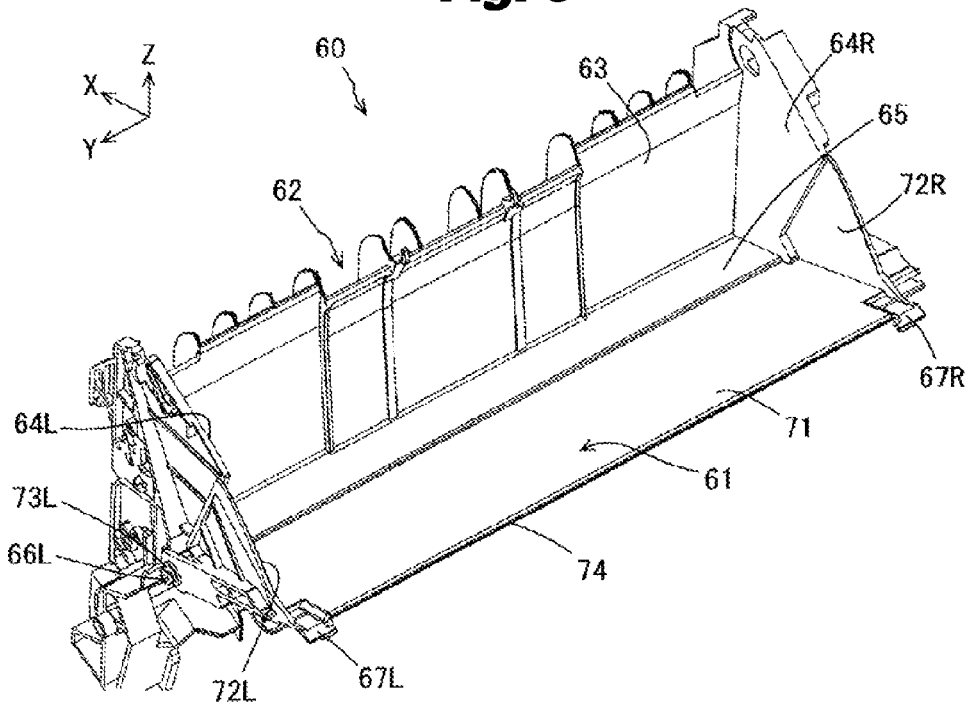
FIG. 9 illustrates an external perspective view of the ejection cover unit illustrated in FIG. 8, viewed from another angle.

FIG. 3 illustrates an external perspective view of the image forming apparatus 1. FIG. 4 illustrates an external perspective view of a top cover unit 40 when the top cover unit 40 is locked to a front unit 45. FIG. 5 illustrates a standalone external perspective view of the top cover unit 40. FIG. 6 illustrates an external perspective views of a top cover 41. FIG. 7 illustrates an external perspective view of the top cover 41, viewed from another angle. FIG. 8 illustrates an external perspective view of an ejection cover unit 60. FIG. 9 illustrates an external perspective view of the ejection cover unit 60, viewed from another angle.

FIG. 3 illustrates a state in which the top cover unit 40 that is arranged in the upper portion of the image forming apparatus 1 is closed. As illustrated in FIG. 5, the top cover unit 40 has the top cover 41 as a first cover member that is made of plastic resin and configures a part of external covering of the image forming apparatus 1, and the inner plate 42 that is made of a metal plate and is arranged on an inner side of the top cover 41 and is integrally fixed to the top cover 41 by a plurality of screws.

On two sides on left and right of the inner plate 42, a pair of supporting point parts 43L, 43R (of which only 43L is illustrated in the drawings, and which may be referred to as the supporting point part 43 when it is not necessary to particularly distinguish between them) as a first rotation point that form a rotation shaft for rotatably holding the top cover unit 40 on the body of the image forming apparatus 1 are formed in a manner coaxially protruding leftward and rightward.

As illustrated in FIG. 1, the pair of the supporting point parts 43L, 43R are respectively held by the body of the image forming apparatus 1 on a rotation axis line parallel to the Y-axis on a back side (plus side of the X-axis) of the image forming apparatus 1. Further, between the inner plate 42 and the body of the image forming apparatus 1, a biasing member such as a torsion spring is interposed. As a result, the top cover 41 is rotatable about the supporting point part 43 between an open position (to be described later) and a close position illustrated in FIG. 3, and is biased in an opening direction.

As illustrated in FIG. 5, on a rotation front end side of the inner plate 42, a pair of opening parts 44L, 44R are formed. FIG. 10 is for describing a lock mechanism of the top cover unit 40 that is due to the opening part 44L and a lock bar 46 provided on the front cover 45.

As illustrated in FIG. 10, at a position where a claw part 47 of the lock bar 46 can be fitted into the opening part 44L of the inner plate 42 by rotation to allow the top cover 41 to be engaged at the close position, a supporting point part 48 of the lock bar 46 is rotatably held by the front unit 45 (FIG. 4) that is fixed on the body of the image forming apparatus 1. The lock bar 46 is biased in an arrow A direction, in which the claw part 47 fits into the opening part 44L of the inner plate 42, by a biasing member such as torsion spring interposed between the lock bar 46 and the front unit 45.

Therefore, to unlock the top cover 41 that is engaged at the close position by the lock mechanism, the lock bar 46 in an engaging position (illustrated by a solid line in FIG. 10), where the claw part 47 of the lock bar 46 is fitted into the opening part 44L of the inner plate 42 to engage the top cover 41 to the close position, is moved by an operator against a biasing force to a release position (illustrated by a solid line in FIG. 10), where the claw part 47 is disengaged from the opening part 44L of the inner plate 42. Here, the lock mechanism of the opening part 44L is described. The same lock mechanism is also provided for the opening part 44R.

As illustrated in FIGS. 6 and 7, the top cover 41 has: an outer frame part 50 that is arranged in a substantially square shape; a sheet placing surface 51 (or first sheet placing surface) having a shaft side end part 52 that is formed in a manner slightly curved downwardly from a front end side (minus side of the X-axis) of the outer frame part 50 toward the supporting point part 43 (rotation shaft; see FIGS. 4 and 5) and is parallel to a rotation axial direction; rib-shaped left and right contact parts 53L, 53R (which may be referred to as the contact parts 53 (or first contact part) when it is not necessary to distinguish between them), as a first contact part, that are continuously formed on a pair of side wall parts that are formed in a perpendicular direction between an upper portion of the outer frame part 50 and left and right ends of a curved portion of the sheet placing surface 51, and extend more than the shaft side end part 52 toward a shaft direction; and an opening 49 surrounded by a shaft side upper end part 54 (see FIG. 4) of the outer frame part 50, the shaft side end part 52 and the left and right contact parts 53L, 53R.

Next, with reference to FIGS. 8 and 9, the ejection cover unit 60 is described. The ejection cover unit 60, together with the top cover 41, is a part of the external covering of the image forming apparatus 1 that is made of plastic resin, and is configured by an ejection frame 62 and an ejection cover 61 as a second cover member. As illustrated in FIG. 3, when the ejection cover unit 60 is provided on the body of the image forming apparatus 1, the ejection cover unit 60 is positioned at the opening 49 portion of the top cover 41. As will be described later, the ejection cover unit 60 is configured in such a manner that in conjunction with an opening and closing operation of the top cover 41, the ejection cover 61 opens and closes between an open position (to be described later) and a close position illustrated in FIGS. 8 and 9. As will be described later, when the top cover 41 and the ejection cover 61 are in the close position, the opening 49 of the top cover 41 is blocked by the ejection frame 62 and the ejection cover 61.

The ejection frame 62 is provided with a regulatory wall part 63 that faces a trailing edge side in an ejection direction of the recording sheet 35 that is ejected from the image forming apparatus 1 and is placed on the sheet placing surface 51, a pair side wall parts 64L, 64R that extend from two left and right end parts of the regulatory wall part 63 to a downstream side (minus side of the X-axis) of sheet ejection direction, and a fixed bottom part 65 that similar extends in the same direction from a lower end part of the regulatory wall part 63. Further, on outer sides of the side wall parts 64L, 64R and at positions near front ends of the fixed bottom part 65, left and right posts 66L, 66R (which may be referred to as the posts 66 when it is not necessary to particularly distinguish between them), as a second rotation supporting point, are respectively formed in a manner protruding outwardly.

The ejection cover 61 is provided with a sheet placing surface 71 (or second sheet placing surface) that is formed in a flat plate shape, and a pair of side surface parts 72L, 72R that extend in a perpendicular direction from two left and right end parts of the sheet placing surface 71 and respectively oppose the side wall parts 64L, 64R of the ejection frame 62 on outer sides of the side wall parts 64L, 64R. Further, on outer sides of the side surface parts 72L, 72R and at positions near the fixed bottom part 65 side of the sheet placing surface 71, a pair of shaft holes 73L, 73R are formed into which the pair of the posts 66L, 66R are respectively rotatably fitted.

Further, on two end parts on a front end side (opposite to the side where the shaft holes 73L, 73R are formed) of the sheet placing surface 71, a receiving part 67L in contact with the left side contact part 53L of the top cover 41 and a receiving part 67R in contact with the contact part 53R of the top cover 41 are formed (the receiving parts 67L, 67R may be referred to as the receiving parts 67 when it is not necessary to particularly distinguish between them). The receiving parts 67 correspond to a second contact part.

Figure 13:
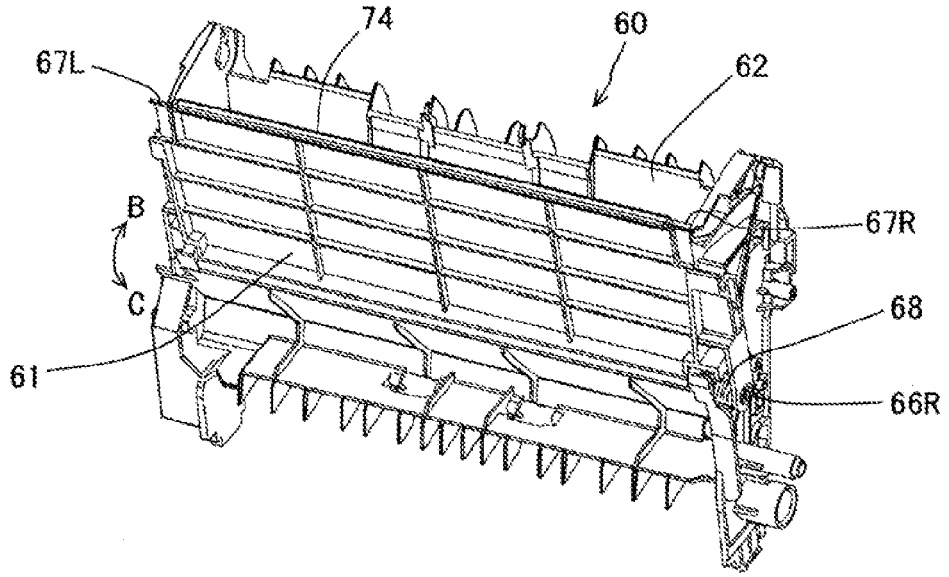
FIG. 13 illustrates an enlarged view of the ejection cover unit illustrated in FIG. 12.
Figure 16A:
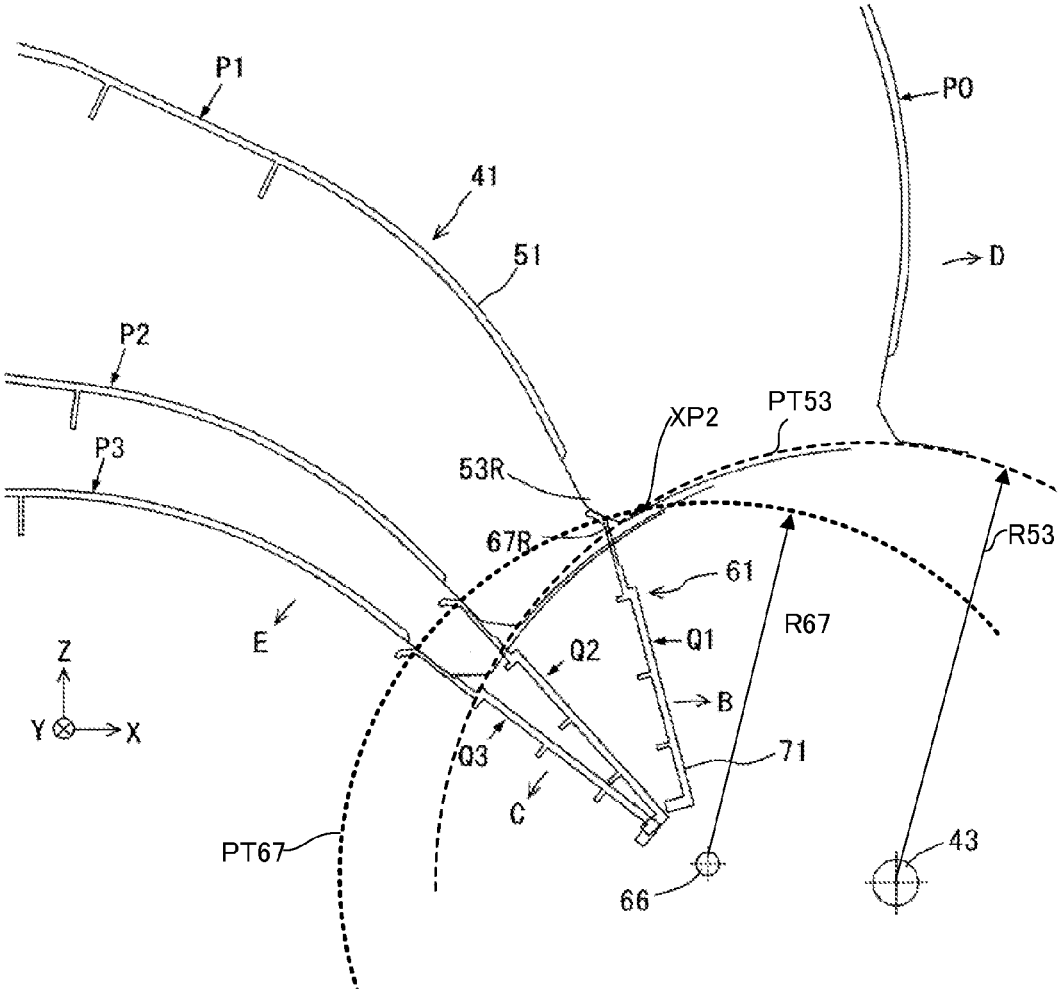
FIG. 16A illustrates an operation explanatory diagram illustrating a state viewed from a minus side of a Y-axis in which a contact part of the top cover and a receiving part of the ejection cover become in contact with each other during the process in which the top cover is closed, in the first embodiment.

Therefore, the ejection cover 61 is rotatably held by the ejection frame 62 and is configured rotatable between a close position, at which, as illustrated in FIG. 8, the fixed bottom part 65 of the ejection frame 62 and the sheet placing surface of the ejection cover 61 are flush with and adjacent to each other, and an open position, at with, as illustrated in FIG. 13 to be described later, the regulatory wall part 63 and the sheet placing surface 71 oppose each other. Further, the ejection cover 61 is biased in an arrow B direction (FIG. 8), which is an opening direction, by a torsion spring 68 (FIG. 13) as a biasing member that is interposed between the ejection cover 61 and the ejection frame 61 and, in a natural state, is maintained at the open position as illustrated in FIG. 13. The open position is illustrated in FIG. 16A with reference Q1.

FIG. 11 illustrates a state in which the ejection cover unit 60 is arranged at a predetermined position of the image forming apparatus 1 and the top cover 41 is locked at the close position by the lock mechanism. As illustrated in FIG. 11, in this case, an upper end part of the regulatory wall part 63 of the ejection cover unit 60 is flush with the shaft side upper end part 54 (FIG. 4) of the opening 49 of the top cover 41; the left and right contact parts 53L, 53R of the top cover 41 and the left and right side wall parts 64L, 64R of the ejection frame 62 are flush with each other; and a front end part 74 formed in the rotation axial direction of the ejection cover 61 overlaps on an upper side with the shaft side end part 52 (FIG. 7) of the top cover 41 so that the sheet placing surface 71 of the ejection cover 61 in the close position and the sheet placing surface 51 of the top cover 41 are flush with each other. Further, in this case, as will be described later, the contact parts 53L, 53R of the top cover 41 and the receiving parts 67L, 67R of the ejection cover 61 are in a state of being in contact with each other.

Next, relation between the top cover 41 and the ejection cover 61 during opening and closing of the top cover 41 is further explained.

Figure 12:
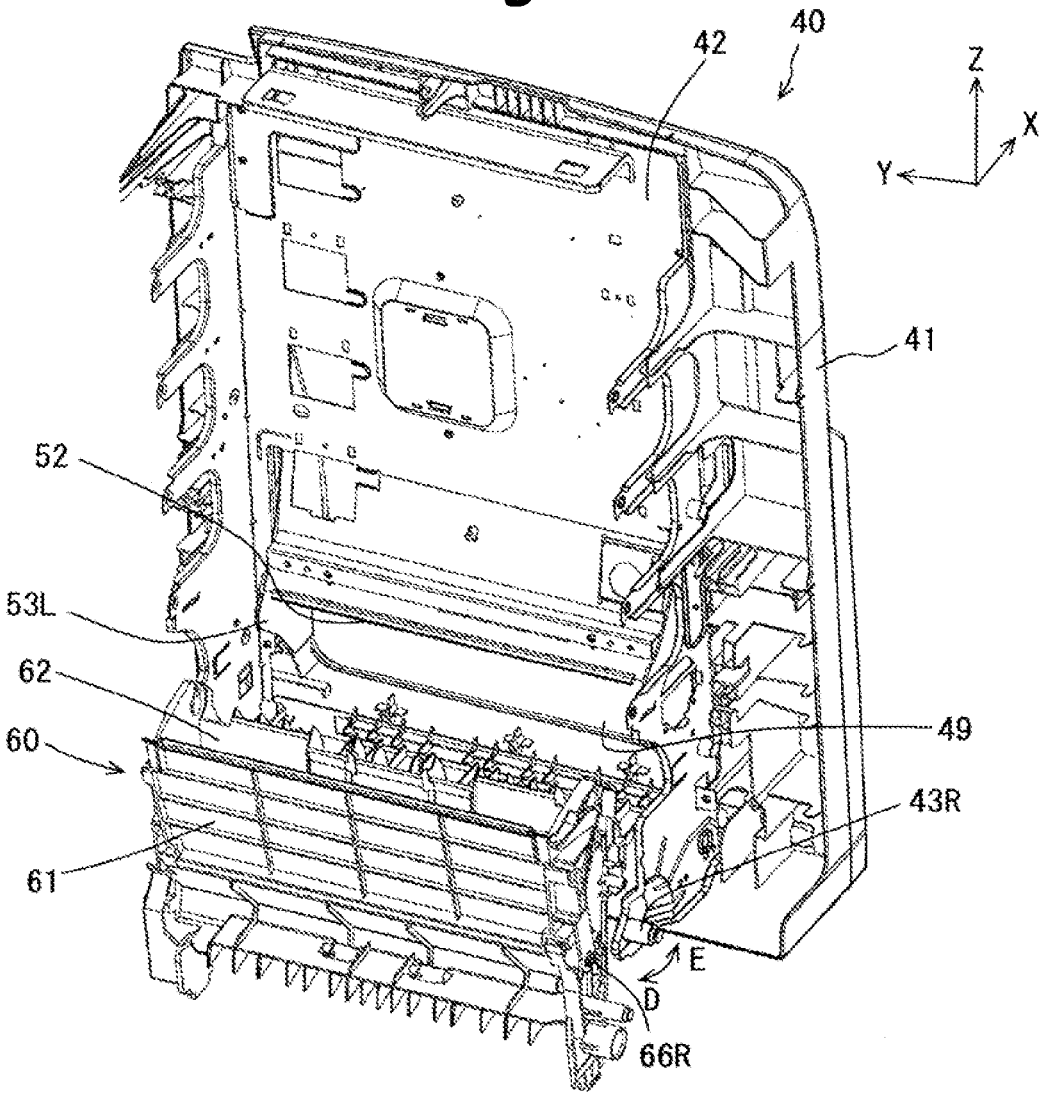
FIG. 12 illustrates a state in which, in the cover opening and closing mechanism of the first embodiment, the top cover and an ejection cover are both in open positions.
Figure 14:
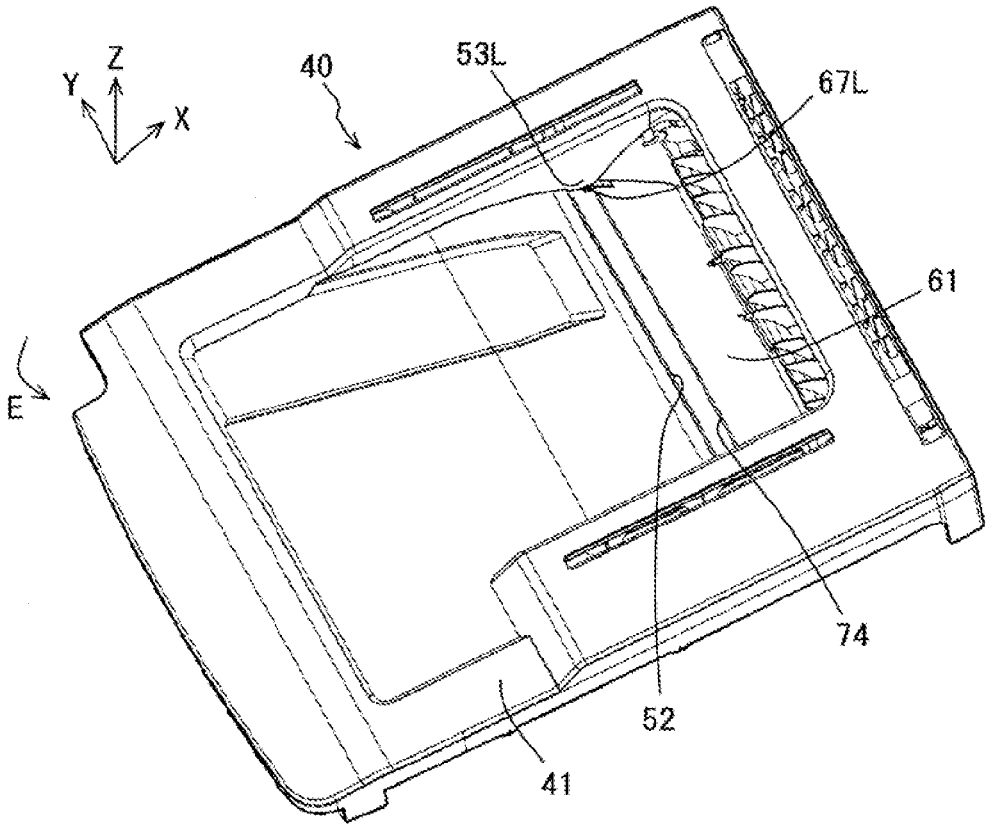
FIG. 14 illustrates an external perspective view illustrating a positional relation between the top cover and the ejection cover in a process in which the top cover is closed, in the first embodiment.
Figure 15:
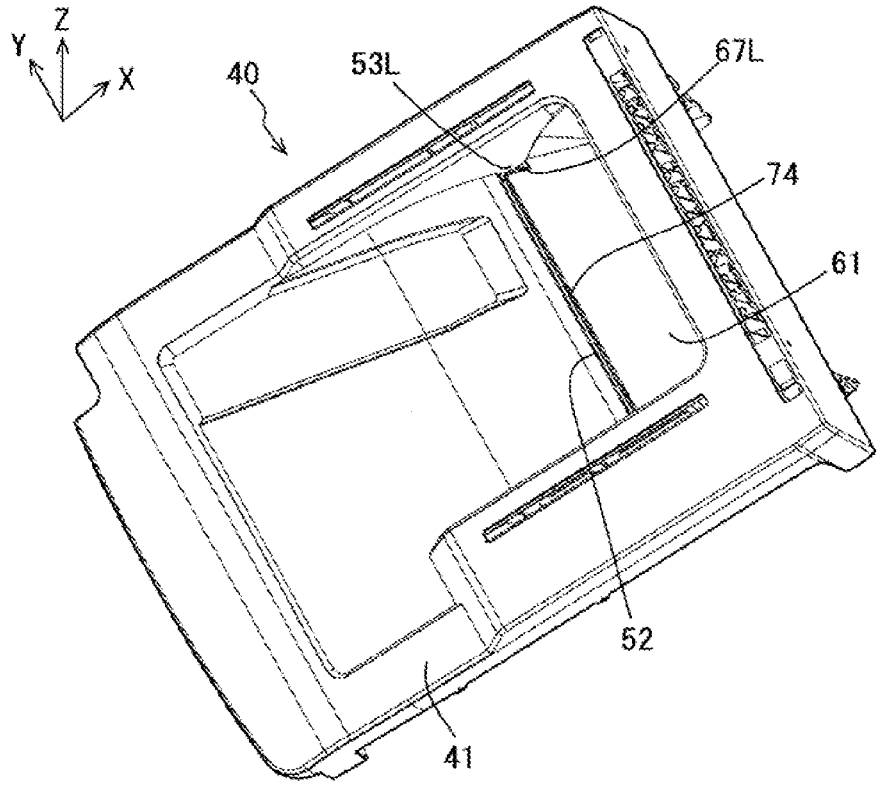
FIG. 15 illustrates an external perspective view illustrating a positional relation between the top cover and the ejection cover in the process in which the top cover is closed, in the first embodiment.

FIG. 12 illustrates state in which, in the cover opening and closing mechanism of the present embodiment, the top cover 41 and the ejection cover 61 are both in the open position. FIG. 13 illustrates an enlarged view of the ejection cover unit 60 illustrated in FIG. 12. FIGS. 14 and 15 illustrate external perspective views illustrating a positional relation between the top cover 41 and the ejection cover 61 in a process in which the top cover 41 is closed. FIGS. 16A-18D illustrate operation explanatory diagrams of the top cover 41 and the ejection cover 61 in the process in which the top cover 41 is moving toward the close position (P3).

Figure 16B:
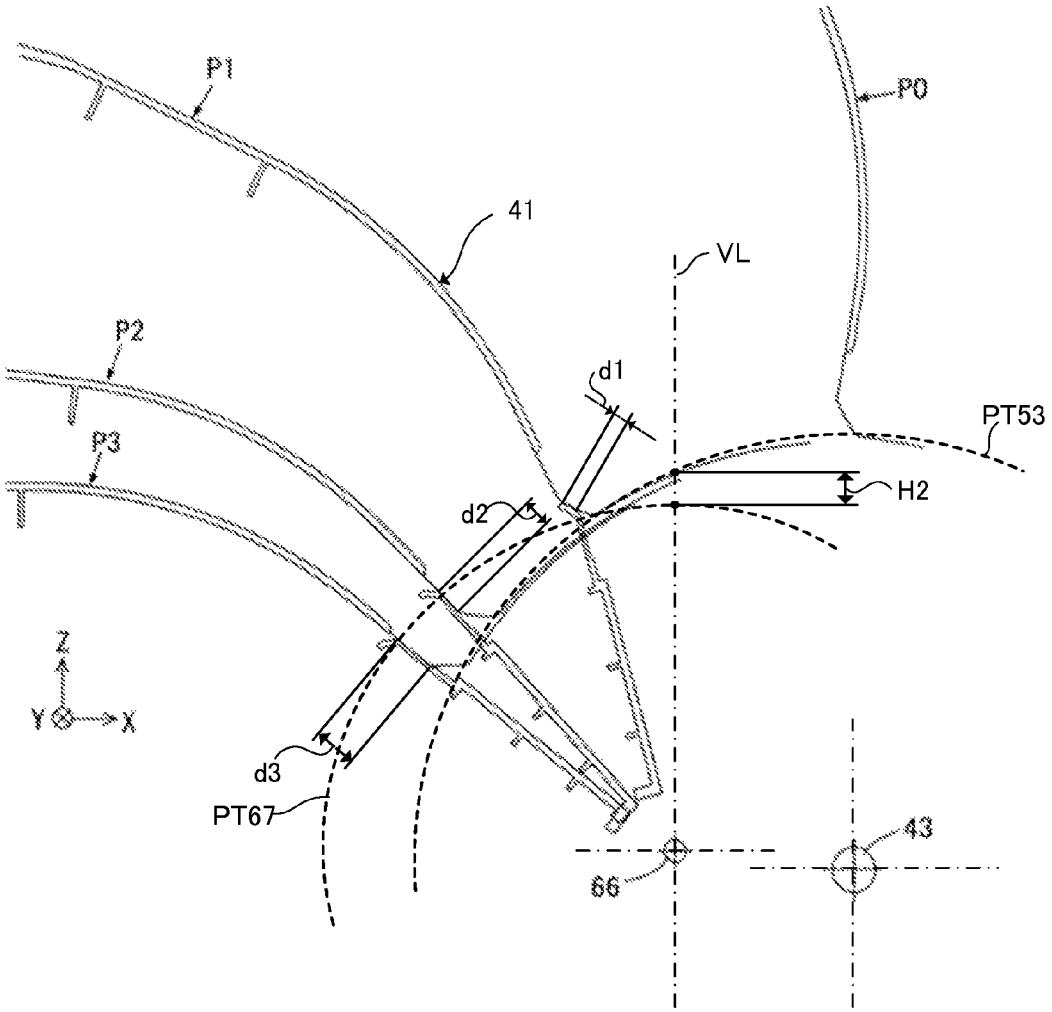
FIG. 16B illustrates a height difference H2 and contact lengths d1 to d3.

FIGS. 16A and 16B illustrate operation explanatory diagrams illustrating a state viewed from a minus side of the Y-axis in which the contact part 53R of the top cover 41 and the receiving part 67R of the ejection cover 61 become in contact with each other during a process in which the top cover 41 is moving to be closed. FIG. 16A illustrates, using solid lines, respective states of the top cover 41 at four places from a rotation position P0, which is the open position, to a rotation position P3, which is the close position, when the top cover 41 rotates in directions of arrows D, E about the supporting point part 43 (equivalent to a rotation shaft). FIG. 16A also illustrates, using solid lines, respective states of the ejection cover 61 at three places from a rotation position Q1 at the open position to a rotation position Q3 at the close position, when the ejection cover 61 rotates in directions of arrows B, C about the post 66 (equivalent to a rotation shaft).

As illustrated in FIG. 16, when the top cover unit 40 (FIG. 12) is rotated, for example, by an operator, from a state (state of FIG. 12) in which the top cover 41 and the ejection cover 61 are at the rotation positions P0 and Q1, which are both the open positions, in the arrow E direction against the biasing force so as to be closed, along with this rotation, the top cover 41 illustrated in FIG. 16 rotates in the arrow E direction from the rotation position P0, which is equivalent to the open position, to the rotation position P3, which is equivalent to the close position. Due to a bias force toward direction B, the ejection cover 61 is positioned at rotation position Q1 with a normal state.

Figure 18A:
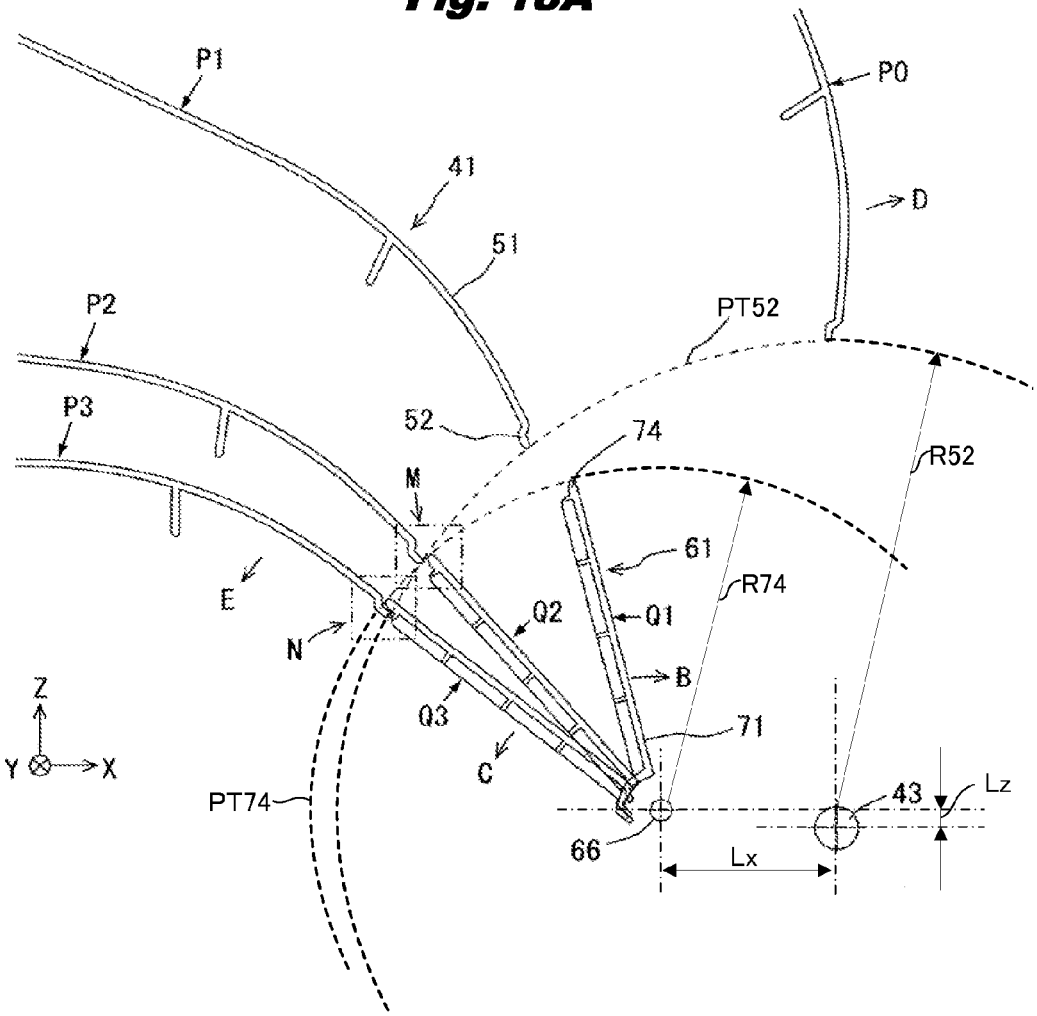
FIG. 18A illustrates an operation explanatory diagram illustrating a state viewed from the minus side of the Y-axis in which the shaft side end part of the top cover and the front end part of the ejection cover oppose (engage) each other during the process in which the top cover is closed, in the first embodiment.
Figure 18B:
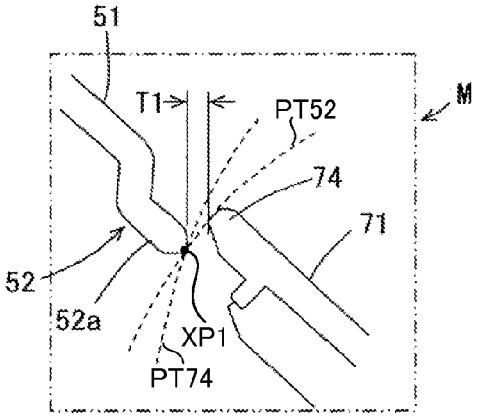
FIG. 18B illustrates a partial enlarged view of a rectangular surrounding portion M in FIG. 18A.

In the rotation process in the arrow E direction, at the rotation position P1, the contact part 53R of the top cover 41 becomes in contact with the receiving part 67R of the ejection cover 61 in the rotation position Q1 (the open position), and thereafter, the ejection cover 61 rotates in the arrow C direction against the biasing force thereof. After the contact part 53R of the top cover 41 and the receiving part 67R of the ejection cover 61 become in contact with each other at the rotation position P1 of the top cover 41, and until the close position P3, an area where the contact part 53R of the top cover 41 and the receiving part 67R of the ejection cover 61 can be in contact with each other gradually increases and a contact state is ensured. These contact lengths d1 to d3 of the area are illustrated in FIG. 16B. The contact length d1 corresponds to the open position P1. The contact length d2 corresponds to the position P2, and the contact length d3 corresponds to the close position P3. This is because in a situation where the open position (rotation position P1) of the ejection cover 61 at the start of the engagement is inclined more toward a counterclockwise direction than a vertically upward direction, the rotation shaft (supporting point part 43, or first rotation point) of the top cover 41 is at least positioned more on a plus side of the X-axis than the rotation shaft (post 66 or second rotation point) of the ejection cover 61. A shortest distance L0 between the supporting point part 43 and the post 66 is illustrated in FIG. 18B. A distance in X-direction is with Lx, and a distance in Z-direction is with Lz as shown in FIG. 18A.

Here, the relation between the contact part 53R of the top cover 41 and the receiving part 67R of the ejection cover 61 is described. However, the contact part 53L of the top cover 41 and the receiving part 67L of the ejection cover 61, which are the other sides of the pairs, are configured to have a similar relation and similarly interact with each other.

Figure 17:
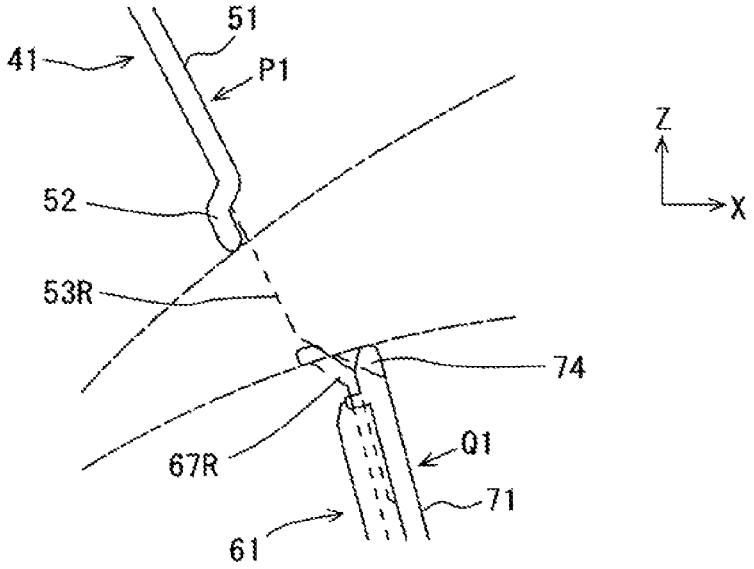
FIG. 17 illustrates an operation explanatory diagram illustrating a relation between a shaft side end part of the top cover and a front end part (or distal end) of the ejection cover when the top cover and the ejection cover are respectively in rotation positions P1, Q1, in the first embodiment.

FIG. 17 illustrates an operation explanatory diagram illustrating a relation between the shaft side end part 52 of the top cover 41 and the front end part 74 of the ejection cover 61 when the top cover 41 and the ejection cover 61 are respectively in the rotation positions P1, Q1. FIG. 14 illustrates an external perspective view of the top cover unit 40 illustrating a state in this case.

As illustrated in these figures, at the stage where the contact part 53 of the top cover 41 and the receiving part 67 of the ejection cover 61 begin to be in contact with each other, the shaft side end part 52 of the sheet placing surface 51 of the top cover 41 and the front end part 74 of the sheet placing surface 71 of the ejection cover 61 are still in a separated state.

FIG. 18A illustrates an operation explanatory diagram illustrating a state viewed from the minus side of the Y-axis in which the shaft side end part 52 of the sheet placing surface 51 of the top cover 41 and the front end part 74 of the sheet placing surface 71 of the ejection cover 61 oppose (engage) each other during a process in which the top cover 41 is closed. FIG. 18A illustrates, using solid lines, respective states of the top cover 41 at four places from the rotation position P0, which is the open position, to the rotation position P3, which is the close position, when the top cover 41 rotates in the directions of the arrows D, E about the supporting point part 43 (equivalent to a rotation shaft).

Figure 18C:
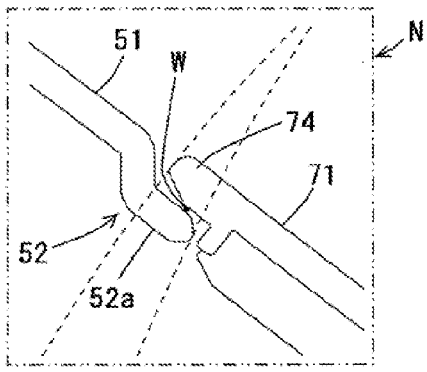
FIG. 18C illustrates a partial enlarged view of a rectangular surrounding portion M in FIG. 18A.
Figure 18D:
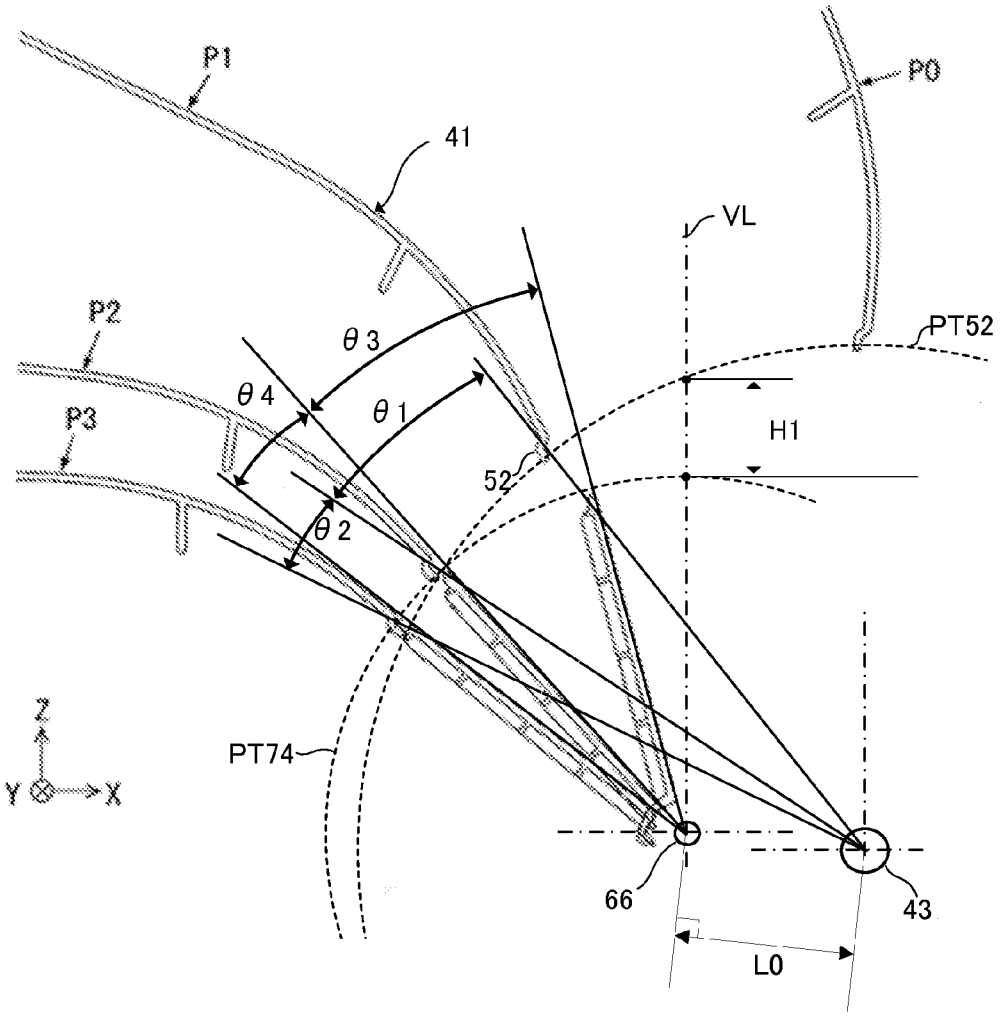
FIG. 18D illustrates a height difference H1 and rotation angles θ1 to θ4.

FIG. 18A also illustrates, using solid lines, respective states of the ejection cover 61 at three places from the rotation position Q1 at the open position to the rotation position Q3 at the close position, when the ejection cover 61 rotates in the directions of the arrows B, C about the posts 66 (equivalent to a rotation shaft). The rotation positions P0-P3, Q1-Q3 are common to the respective rotation positions indicated using the same reference numeral symbols illustrated in FIG. 16. FIG. 18B illustrates a partial enlarged view of a rectangular surrounding portion M in FIG. 18A; and FIG. 18C illustrates a partial enlarged view of a rectangular surrounding portion M in FIG. 18A.

In FIG. 18A, a movement path PT52 as a first movement path is a movement path of the shaft side end part 52 of the sheet placing surface 51 of the top cover 41, and a movement path PT74 as a second movement path is a movement path of the front end part 74 of the sheet placing surface 71 of the ejection cover 61. As described above, in the process in which the top cover 41 rotates from the open position in the arrow E direction, the contact part 53 of the top cover 41 becomes in contact with the receiving part 67 of the ejection cover 61 at the rotation position P1, and thereafter, along with the rotation of the top cover 41 in the arrow E direction, the ejection cover 61 rotates in the arrow C direction.

The rotation position P2 is a rotation position of the top cover 41 when the shaft side end part 52 of the top cover 41 reaches a cross point XP1 of the movement paths PT52, PT74. As the movement paths PT52, PT74 illustrate, the shaft side end part 52 of the top cover 41 moves on an outer side of an arc of the movement path PT74 of the front end part 74 of the sheet placing surface 71 until the top cover 41 reaches the rotation position P2, and, after passing the rotation position P2, moves on an inner side of the arc of the movement path PT74 until reaching the rotation position P3 (close position). The front end part 74 of the sheet placing surface 71 extends in a radial direction with respect to the rotation shaft (post 66) of the ejection cover 61.

As illustrated in FIG. 18B, the configuration is provided in such a manner that, in the process in which the top cover 41 is closed, a bent part 52*a* as a first engagement part of the shaft side end part 52 of the top cover 41 reaches the cross point of the movement paths PT52, PT74 first, and thereafter, the front end part 74 of the sheet placing surface 71 of the ejection cover 61 reaches the cross point XP1. A clearance between the bent part 52*a* and the front end part 74 that occurs at the stage where the top cover 41 reaches the rotation position P2 is T1. Further, in this case, the sheet placing surface 51 of the top cover 41 and the sheet placing surface 71 of the ejection cover 61 are substantially flush with each other.

Therefore, as illustrated in FIG. 18B, a cross section of the shaft side end part 52 of the top cover 41 has a crank-like step part with respect to the sheet placing surface 51. The bent part 52*a* of the shaft side end part 52 is displaced toward a downstream side in the direction in which the top cover 41 is closed (in the arrow E direction), with respect to the sheet placing surface 51 and further, as illustrated in FIG. 17, with respect to the contact part 53, and extends toward the supporting point part 43 (equivalent to the rotation shaft). On the other hand, as illustrated in FIG. 17, the front end part 74 as a second engagement part of the sheet placing surface 71 of the ejection cover 61 is positioned on an upstream side in the direction in which the ejection cover 61 is closed (in the arrow B direction), with respect to the receiving part 67.

When the top cover 41 further rotates from the rotation position P2 in the arrow E direction, the bent part 52*a* of the top cover 41 and the front end part 71 of the ejection cover 61 that is positioned on a more upstream side than the bent part 52*a* in the direction in which the ejection cover 61 is closed (in the arrow B direction) begin to overlap in a tangential direction of the arc of the movement path PT74 of the front end part 74 of the sheet placing surface 71.

At the stage where the top cover 41 reaches the rotation position P3 corresponding to the close position of the top cover unit 40, as illustrated in FIG. 18C, the bent part 52*a* of the top cover 41 and the front end part 71 of the ejection cover 61 are formed in such a manner that the bent part 52*a* and the front end part 71 overlap for a required amount and oppose (engage) each other across a gap w. FIG. 15 illustrates an external perspective view of the top cover unit 40 illustrating a state in this case.

In order for the movement paths PT52, PT74 to cross each other, it is necessary to offset the rotation shaft (post 66) of the ejection cover 61 with respect to the rotation shaft (supporting point part 43) of the top cover 41. However, in the situation where the cross point is set to the rotation position Q2 at which the ejection cover 61 is inclined in the counterclockwise direction more than the vertically upward direction, this condition is satisfied when the rotation shaft (supporting point part 43) of the top cover 41 is at least positioned more on the plus side of the X-axis (on the side away from the cross point XP1) than the rotation shaft (post 66) of the ejection cover 61. Here, in order to obtain a sufficient crossing angle and a sufficient overlap amount between the bent part 52*a* of the top cover 41 and the front end part 74 of the ejection cover 61, a distance Lx parallel to the X-axis (distance in a horizontal direction) between the rotation shaft (supporting point part 43) and the rotation shaft (post 66) is set.

When the top cover 41 reaches the rotation position P3, the top cover unit 40 is in the close position and, as described above, is locked at this close position by fitting the claw part 47 of the lock bar 46 (FIG. 10) provided on the front cover 45 into the opening part 44 of the inner plate 42. On the other hand, as illustrated in FIG. 16, the ejection cover 61 remains at the rotation position Q3, which is the close position, in a state in which the receiving part 67 of the ejection cover 61 presses against the contact part 53 of the top cover 41, by the biasing force due to the torsion spring 68 (FIG. 13).

Therefore, in the state in which the top cover unit 40 is in the close position, the outer periphery of the top cover unit 40 is supported by a side cover 80 (FIG. 3) of the body of the image forming apparatus 1 and the front unit 45. In particular, a rotation front end part side of the top cover unit 40 that is in a position farthest from the rotation shaft (supporting point part 43) is supported by the front unit 45. Therefore, a high rigidity is obtained.

On the other hand, in the state in which the ejection cover 61 is in the close position, when the ejection cover 61 is subjected to, for example, a force F in a downward direction (the arrow C direction illustrated in FIG. 16) as illustrated by an arrow F as illustrated in FIG. 11, the ejection cover 61 tends to rotate in the same direction against the biasing force. However, as can be seen from FIG. 18C, the front end part 74 of the ejection cover 61 is in contact with the bent part 52*a* of the shaft side end part 52 of the top cover 41 and the rotation in the same direction is inhibited. As a result, even when the ejection cover 61 is subjected to an external force, the state in which the sheet placing surface 51 of the top cover 41 and the sheet placing surface 71 of the ejection cover 61 are flush with each other is maintained.

Comparison Example

Figure 19:
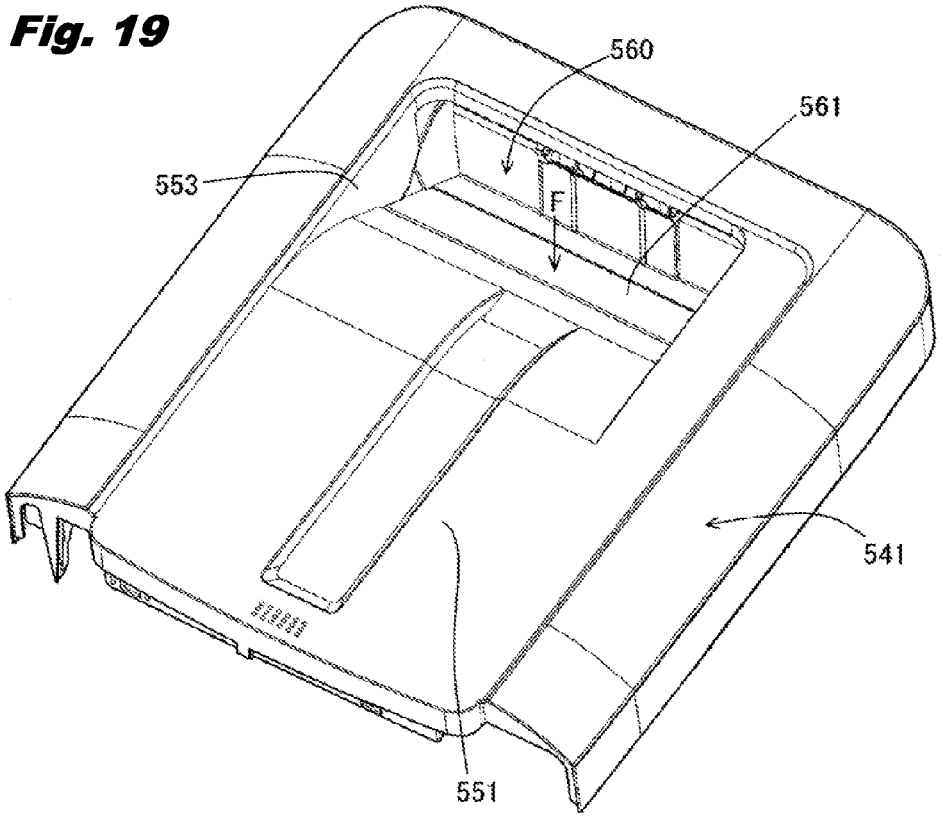
FIG. 19 illustrates a state in which an ejection cover unit is arranged at a predetermined position of an image forming apparatus and a top cover is locked at a close position by a lock mechanism, in a comparative example.
Figure 20:
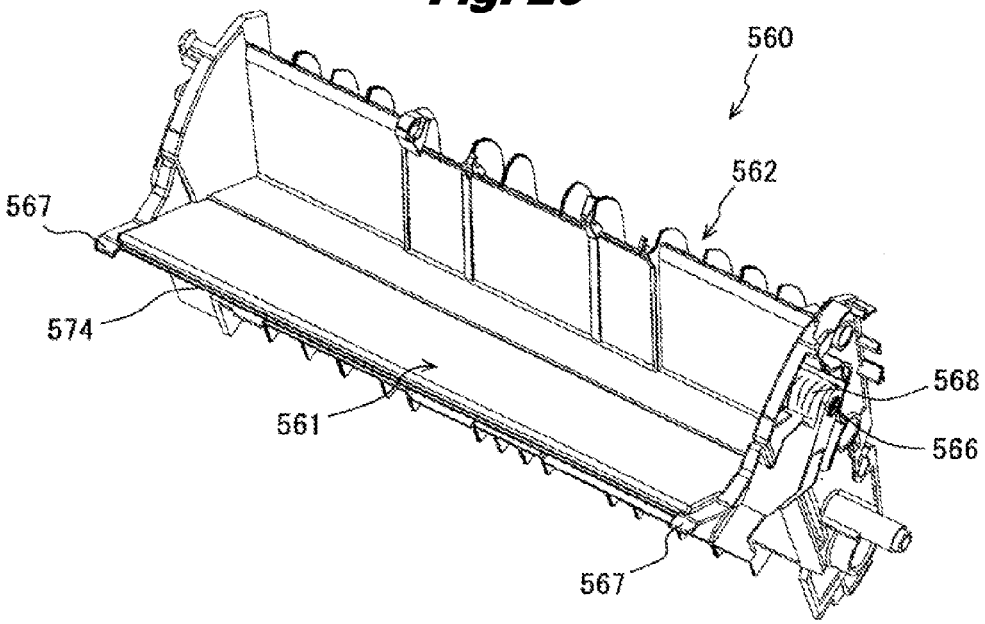
FIG. 20 illustrates an external perspective view of the ejection cover unit of the comparative example.
Figure 21:
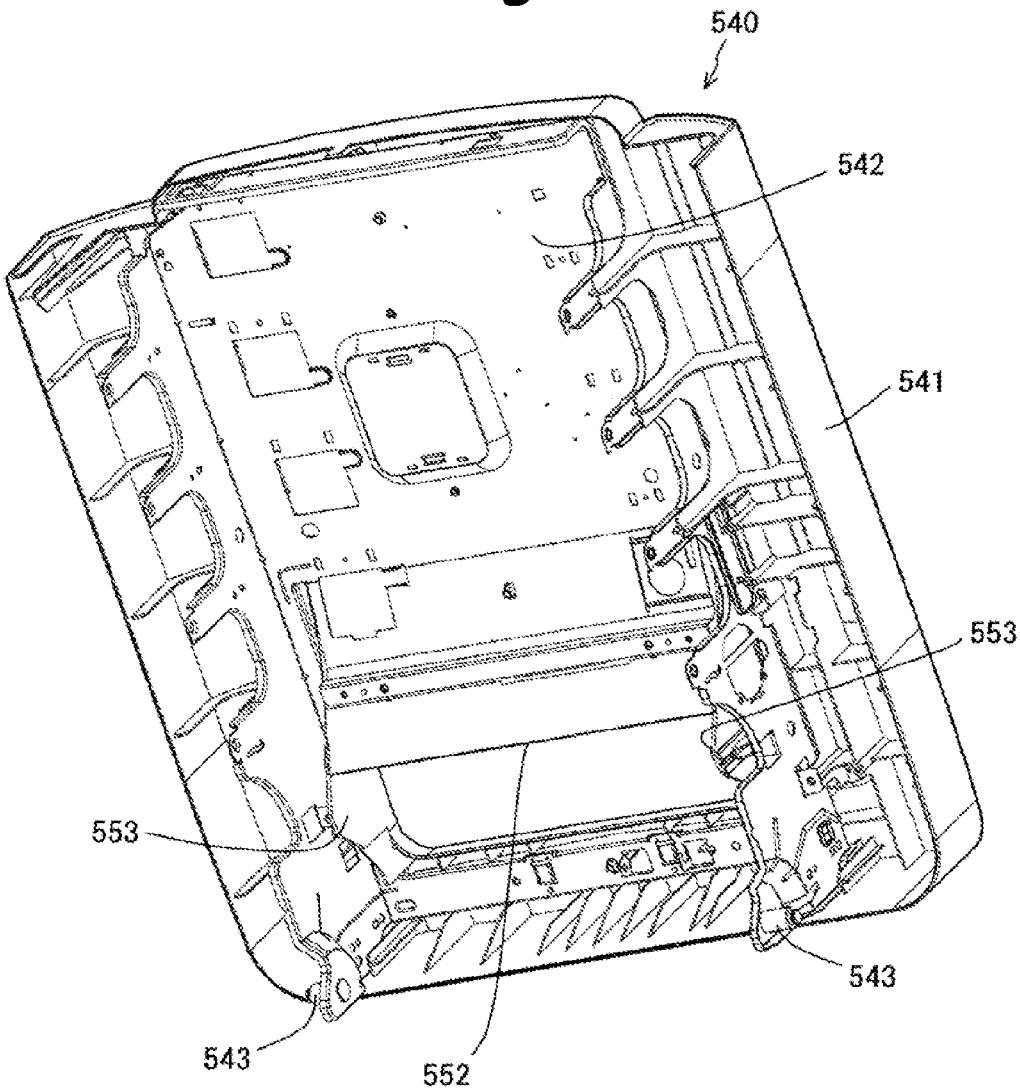
FIG. 21 illustrates an external perspective view of a top cover unit, viewed obliquely from below, in the comparative example.

FIGS. 19-23B illustrate reference diagrams of a cover opening and closing mechanism that is described as comparative example. FIG. 19 illustrates a state in which an ejection cover unit 560 is arranged at a predetermined position of an image forming apparatus and a top cover 541 is locked at a close position by a lock mechanism. FIG. 20 illustrates an external perspective view of the ejection cover unit 560. FIG. 21 illustrates an external perspective view of the top cover unit 540, viewed obliquely from below.

In the cover opening and closing mechanism as the comparative example, similar to the cover opening and closing mechanism of the first embodiment, the top cover unit 540 is formed by a top cover 541 and an inner plate 542, which are integrated, and, on the inner plate 542, a supporting point part 543 is formed as a rotation shaft when the inner plate 542 is rotatably held on a body of the image forming apparatus.

An ejection cover 561 of the ejection cover unit 560 is rotatably held using a post 566 that is formed on an ejection frame 562 as a rotation shaft, is biased in an opening direction by a torsion spring 568, and, similar to the cover opening and closing mechanism of the first embodiment, opens and closes in conjunction with opening and closing of the top cover unit 540. FIG. 20 illustrates a state in which the ejection cover 561 is closed against a biasing force of the torsion spring 568.

A pair of contact parts 553 are formed on the top cover 541. Similar to the cover opening and closing mechanism of the first embodiment, the pair of the contact parts 553 are respectively in contact with a pair of receiving parts 567 that are formed on the ejection cover 561 and open and close the ejection cover 561 that is biased in the opening direction.

Figure 22:
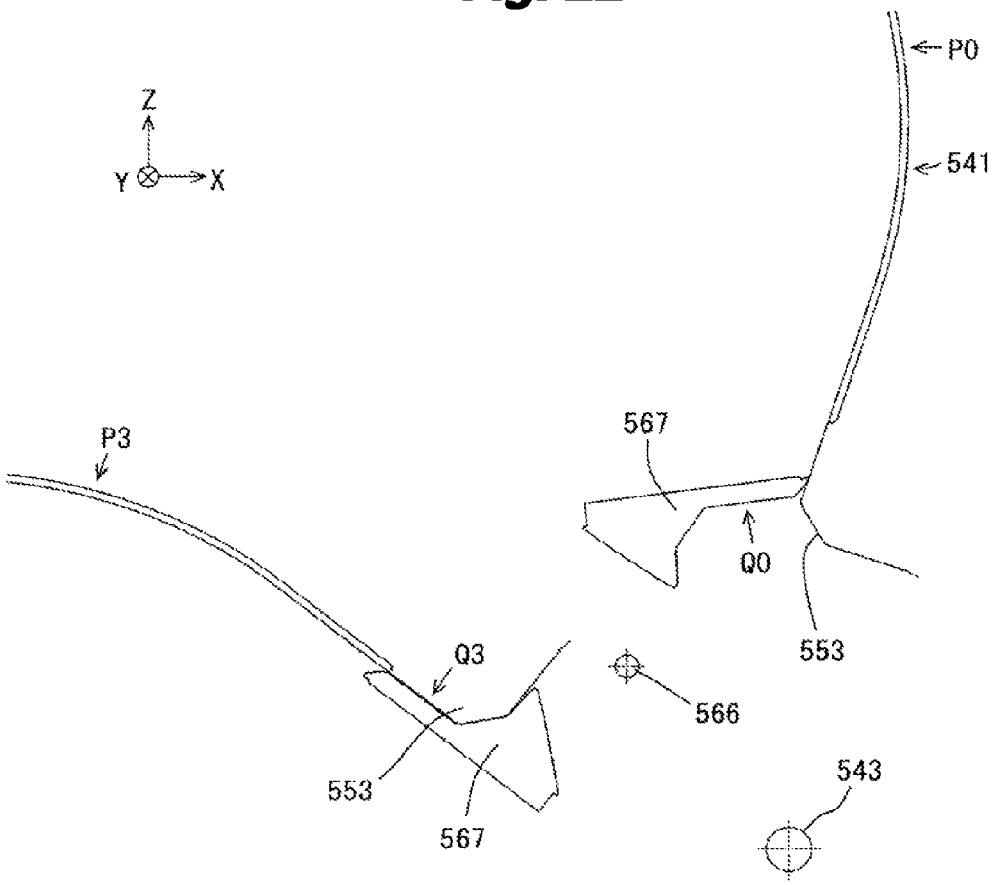
FIG. 22 illustrates an operation explanatory diagram illustrating a state viewed from the minus side of the Y-axis in which a contact part of the top cover and a receiving part of the ejection cover become in contact with each other during a process in which the top cover is closed, in the comparative example.

FIG. 22 illustrates an operation explanatory diagram illustrating a state viewed from the minus side of the Y-axis in which the contact parts 553 of the top cover 541 the receiving parts 567 of the ejection cover 561 become in contact with each other during a process in which the top cover 541 is closed. FIG. 22 illustrates, using solid lines, respective states of the top cover 541 at a rotation position P0, which is an open position, and at a rotation position P3, which is a close position, when the top cover 541 rotates about the supporting point part 543 (equivalent to a rotation shaft). FIG. 22 also illustrates, using solid lines, respective states of the receiving parts 567 of the ejection cover 561 at a rotation position Q0, which is an open position, and at a rotation position Q3, which is a close position, when the ejection cover 561 rotates about the posts 566 (equivalent to a rotation shaft).

As illustrated in FIG. 22, when the top cover unit 540 (FIG. 21) is rotated, for example, by an operator, from a state in which the top cover 541 and the ejection cover 561 are at the rotation positions P0 and Q1, which are both the open positions, so as to be closed, along with this rotation, the top cover 541 rotates from the rotation position P0, which is equivalent to the open position, to the rotation position P3, which is equivalent to the close position. During this rotation, the contact parts 553 of the top cover 541 press against the receiving parts 567 of the ejection cover 561, and the ejection cover 561 is rotated against the biasing force thereof to the rotation position Q3, which is the close position. FIG. 19 illustrates a state when the top cover 541 and the ejection cover 561 are both closed.

Figure 23A:
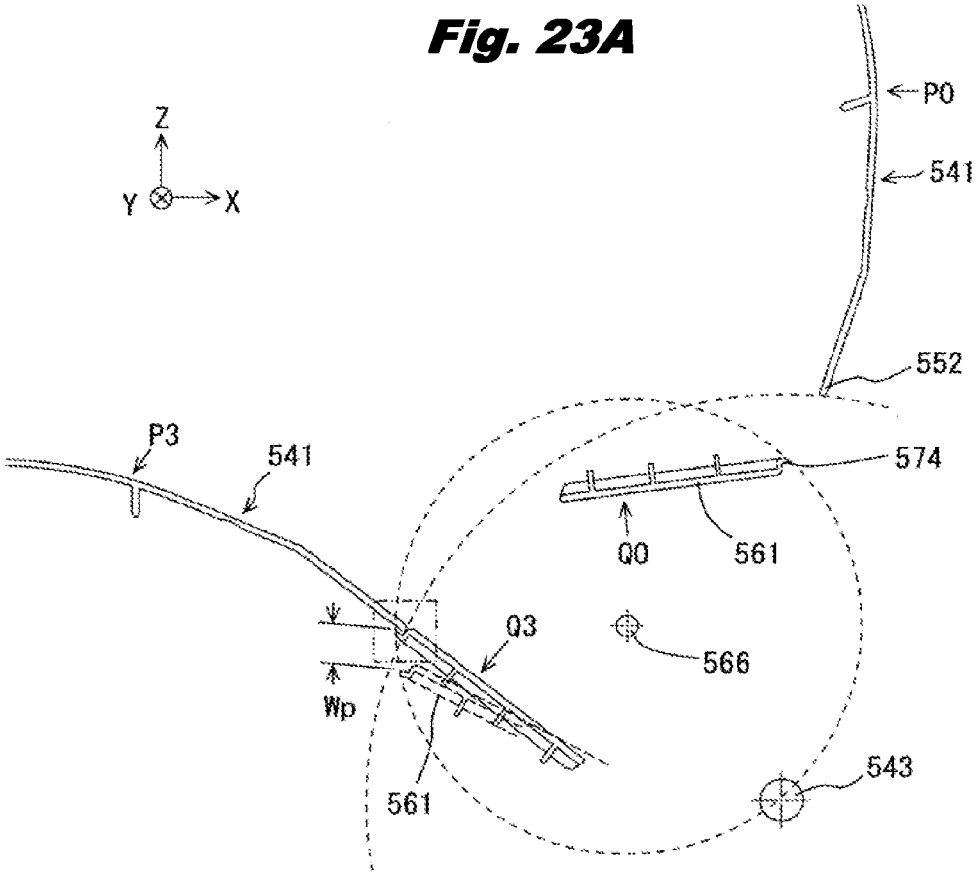
FIG. 23A illustrates an operation explanatory diagram illustrating a state viewed from the minus side of the Y-axis in which the shaft side end part of the top cover and the front end part of the ejection cover oppose (engage) each other during the process in which the top cover is closed, in the comparative example.

FIG. 23A illustrates an operation explanatory diagram illustrating a state viewed from the minus side of the Y-axis in which a shaft side end part 552 of the top cover 541 and a front end part 574 of the ejection cover 561 oppose (engage) each other during a process in which the top cover 541 is closed. FIG. 23A illustrates, using solid lines, respective states of the top cover 541 at the rotation position P0, which is the open position, and at the rotation position P3, which is the close position, when the top cover 541 rotates about the supporting point part 543 (equivalent to a rotation shaft).

Figure 23B:
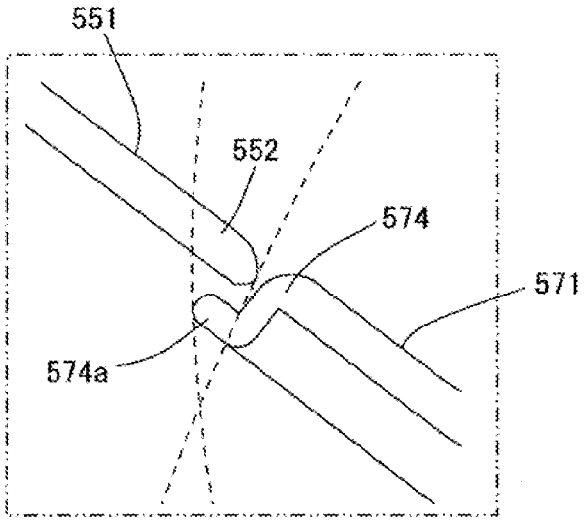
FIG. 23B illustrates an enlarged view of a rectangular surrounding portion in FIG. 23A.

FIG. 23A also illustrates, using solid lines, respective states of the ejection cover 561 at a rotation position Q0, which is the open position, and at the rotation position Q3, which is the close position, when the ejection cover 561 rotates about the posts 566 (equivalent to a rotation shaft). The rotation positions P0-P3, Q1-Q3 are common to the respective rotation positions indicated using the same reference numeral symbols illustrated in FIG. 22. FIG. 23B illustrates an enlarged view of a rectangular surrounding portion in FIG. 23A.

In FIG. 23A, a movement path of the shaft side end part 552 of the top cover 541 and a movement path of the front end part 574 of the ejection cover 561 are indicated using dotted lines. As described above, in the process in which the top cover 541 rotates in the closing direction, along with the rotation of the top cover 541 in the closing direction, the ejection cover 561 rotates in the closing direction.

As the respective movement paths illustrate, the shaft side end part 552 of the top cover 541 and the front end part 574 of the ejection cover 561 cross each other in the respective rotation processes, and while crossing each other, the ejection cover 561 and the top cover 541 reach the close positions. FIG. 19 illustrates a state when the top cover 541 and the ejection cover 561 are both closed, and FIG. 23B illustrates a partial enlarged view of the shaft side end part 552 of the top cover 541 and the front end part 574 of the ejection cover 561 in this case.

As illustrated in FIG. 23B, a sheet placing surface 551 of the top cover 541 and a sheet placing surface 571 of the ejection cover 561 are substantially flush with each other, and a bent part 574*a* that is formed in a crank-like shape overlaps, on a downstream side in the closing direction of the top cover 541, with the front end part 552 of the top cover 541.

When the top cover 541 reaches the rotation position P3, similar to the above-described cover opening and closing mechanism of the first embodiment, the top cover unit 540 is locked to the close position and, as illustrated in FIG. 22, the ejection cover 561 remains at the rotation position Q3, which is the close position, in a state in which the receiving parts 567 of the ejection cover 561 press against the contact parts 553 of the top cover 541, due to the biasing force of the torsion spring 568 (FIG. 20).

Therefore, in the cover opening and closing mechanism of the comparative example, as illustrated in FIG. 19, in a state in which the ejection cover 561 is in the close position, when the ejection cover 561 is subjected to, for example, a downward force F as illustrated by an arrow F, as illustrated by dotted lines in FIG. 23A, the ejection cover 561 rotates in the same direction against the biasing force and a gap Wp occurs in a joining portion of the top cover 541 and the ejection cover 561.

As described above, according to the cover opening and closing mechanism of the present embodiment, when the top cover 41 is in the close position in which the top cover 41 is closed, the front end part 74 of the ejection cover 61 is positioned on a more upstream side (the arrow B direction) in the direction in which the ejection cover 61 is closed than the bent part 52*a* of the shaft side end part 52 of the top cover 41. Therefore, even when an external force is applied to the front end part 74 of the ejection cover 61, rotation is restricted by the bent part 52*a* of the top cover 41, so that a gap does not occur in the joining portion and a good appearance is obtained.

Second Embodiment

Figure 24:
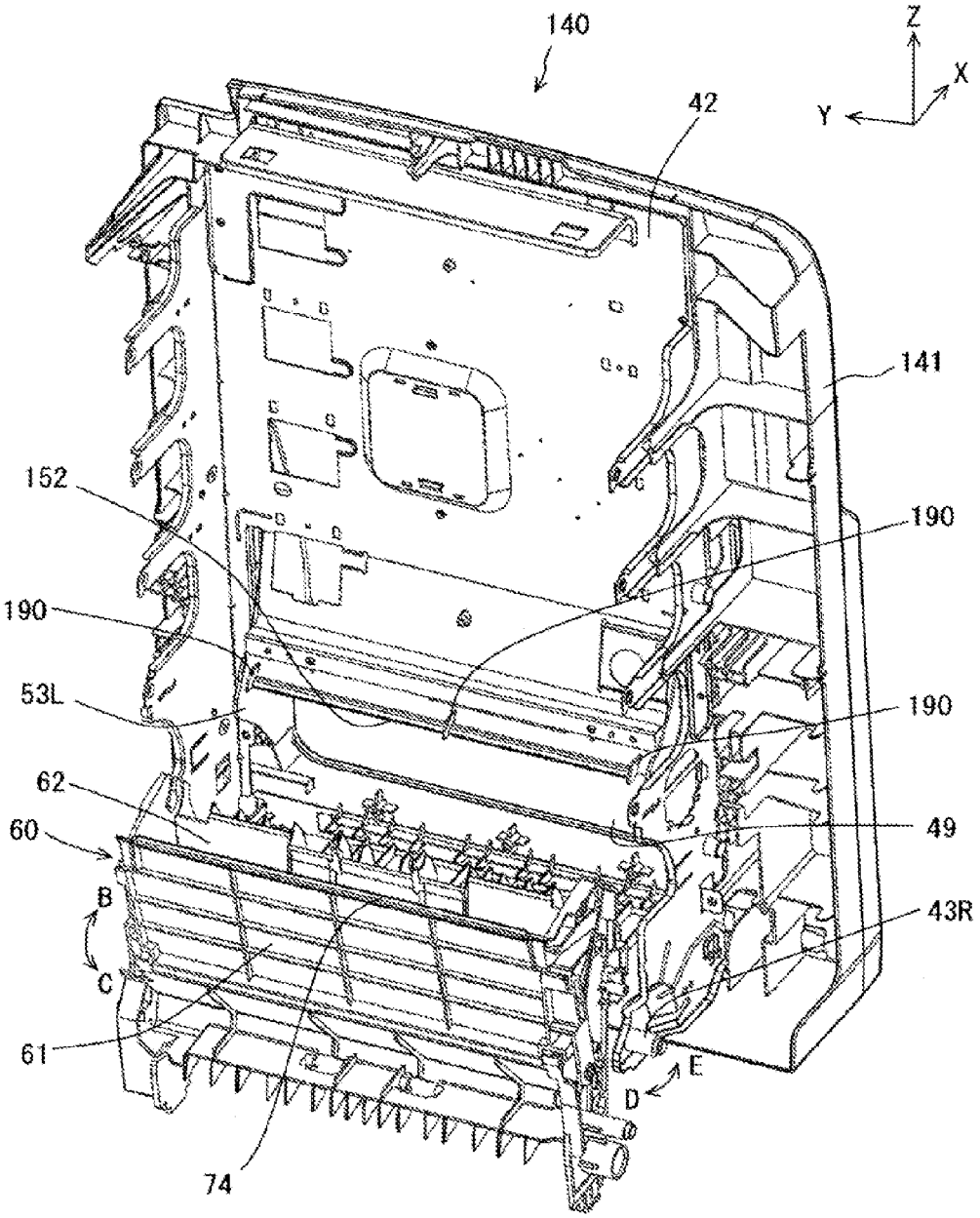
FIG. 24 illustrates state in which, in a cover opening and closing mechanism that is adopted by a second embodiment based on the present invention, a top cover and an ejection cover are both in open positions.
Figure 25:
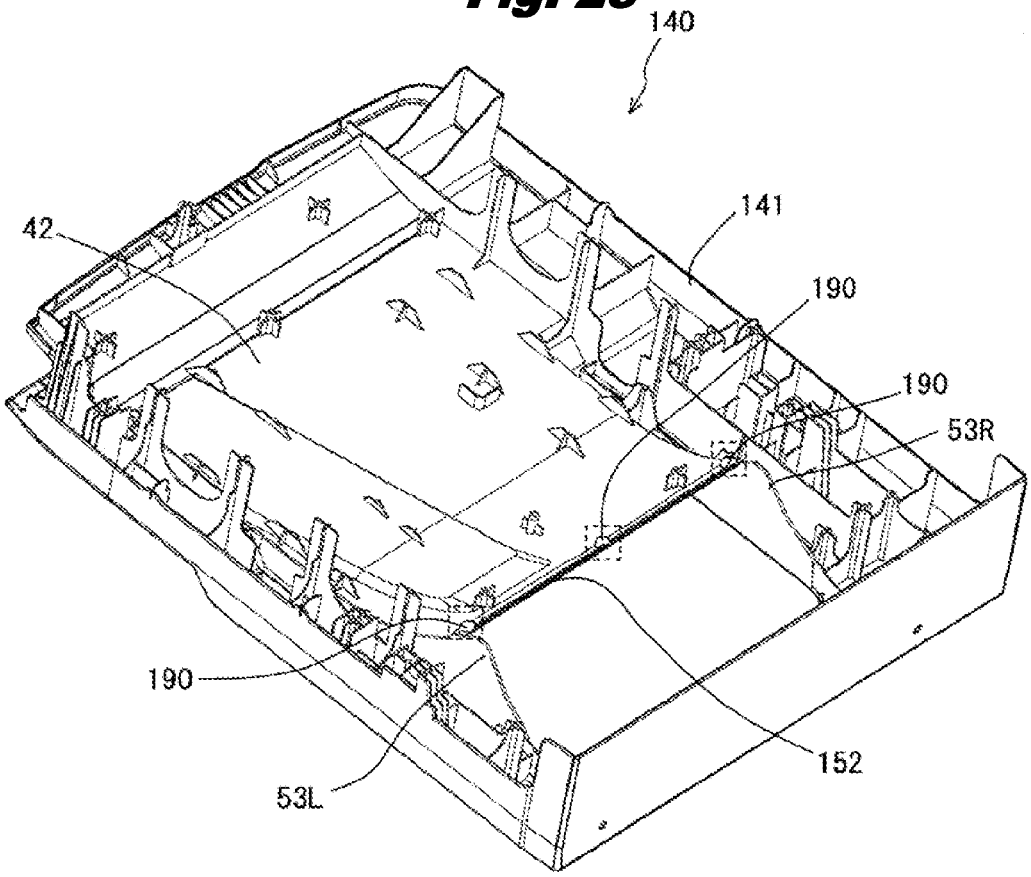
FIG. 25 illustrates an external perspective view of the top cover unit, viewed obliquely from above when the top cover unit is turned upside down, in the second embodiment.
Figure 26:
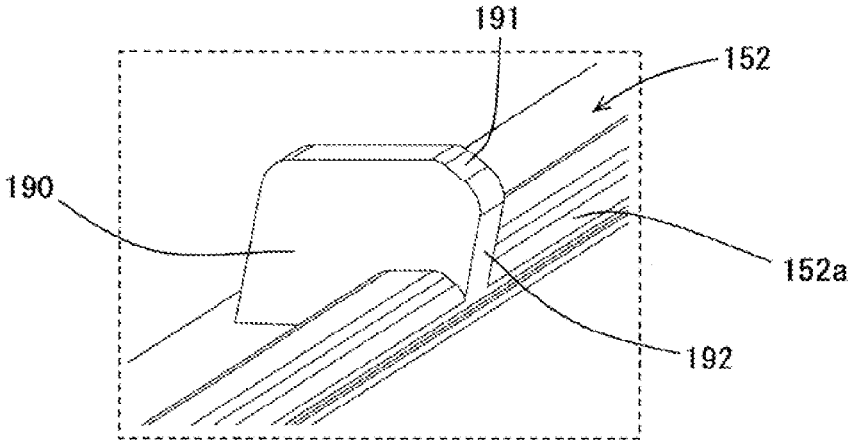
FIG. 26 illustrates a partial enlarged view of a portion surrounded with dotted lines in FIG. 25.

FIG. 24 illustrates state in which, in a cover opening and closing mechanism that is adopted by a second embodiment based on the present invention, a top cover 141 (or first cover member) and an ejection cover 61 (or second cover member) are both in open positions. FIG. 25 illustrates an external perspective view of a top cover unit 140, viewed obliquely from above when the top cover unit 140 is turned upside down. FIG. 26 illustrates a partial enlarged view of a portion surrounded with dotted lines in FIG. 25. FIGS. 27-29B illustrate operation explanatory diagrams of the top cover 141 and the ejection cover 61 in a process in which the top cover 141 is closed.

The image forming apparatus that adopts this cover opening and closing mechanism is mainly different from the above-described image forming apparatus that adopts the cover opening and closing mechanism of the first embodiment illustrated in FIG. 12 in that guide ribs 190 are provided at three places including two end parts and a central part of a shaft side end part 152 of a sheet placing surface 151 (FIGS. 29A and 29B) of the top cover 141. Therefore, for the image forming apparatus that adopts this opening and closing mechanism, parts that are in common with the above-described image forming apparatus 1 of the first embodiment are denoted using the same reference numeral symbols, or are omitted from the drawings and their description is omitted, and differences are mainly described. Further, a main part configuration of the image forming apparatus of the present embodiment, excluding the top cover 141, is in common with the main part configuration of the image forming apparatus 1 of the first embodiment illustrated in FIG. 1. Therefore, FIG. 1 is referenced as needed.

Figure 27:
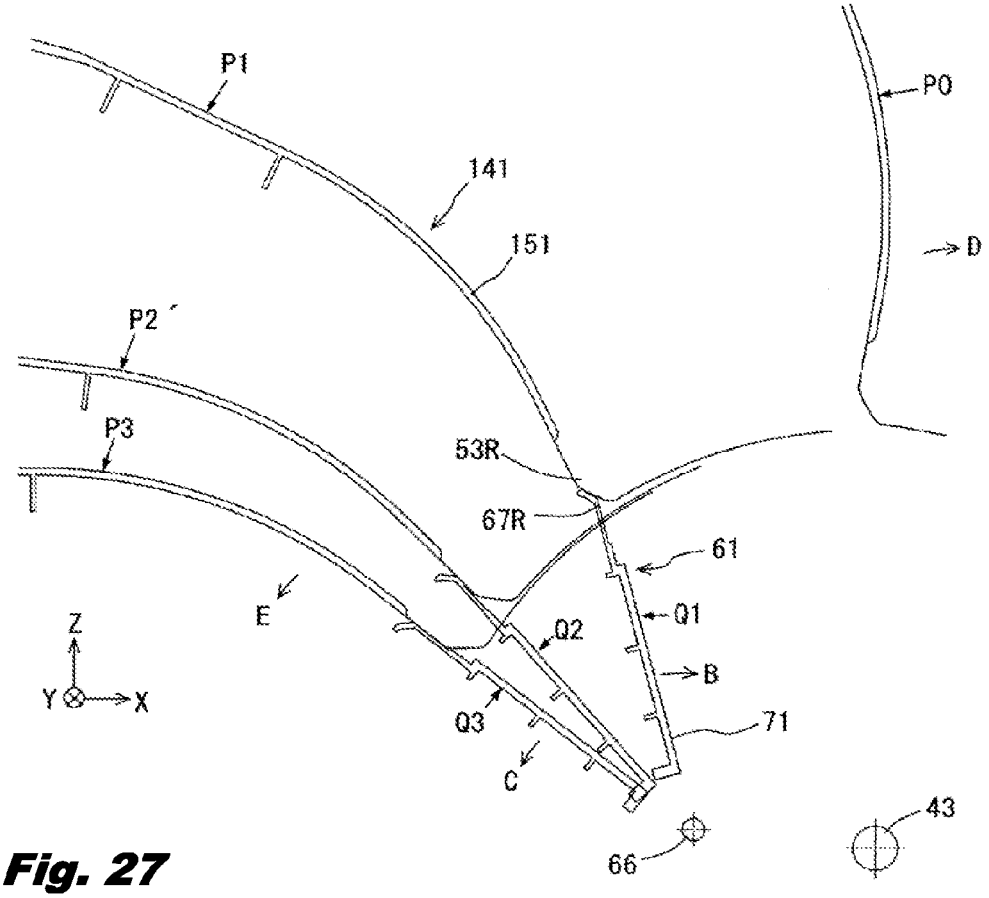
FIG. 27 illustrates an operation explanatory diagram illustrating a state viewed from the minus side of the Y-axis in which a contact part of the top cover and a receiving part of the ejection cover become engaged with each other during a process in which the top cover is closed, in the second embodiment.

FIG. 27 illustrates an operation explanatory diagram illustrating a state viewed from the minus side of the Y-axis in which the contact part 53R of the top cover 141 and the receiving part 67R of the ejection cover 61 become in contact with each other during the process in which the top cover 141 is closed. FIG. 27 illustrates, using solid lines, respective states of the top cover 141 at four places from the rotation position P0, which is the open position, to the rotation position P3, which is the close position, when the top cover 141 rotates in the directions of the arrows D, E about the supporting point part 43 (equivalent to a rotation shaft). FIG. 27 also illustrates, using solid lines, respective states of the ejection cover 61 at three places from the rotation position Q1 at the open position to the rotation position Q3 at the close position, when the ejection cover 61 rotates in the directions of the arrows B, C about the posts 66 (equivalent to a rotation shaft).

As illustrated in FIG. 27, when the top cover unit 140 (FIG. 24) is rotated, for example, by an operator, from a state (state of FIG. 12) in which the top cover 141 and the ejection cover 61 are at the rotation positions P0 and Q1, which are both the open positions, in the arrow E direction against the biasing force so as to be closed, along with this rotation, the top cover 141 illustrated in FIG. 27 rotates in the arrow E direction from the rotation position P0, which is equivalent to the open position, to the rotation position P3, which is equivalent to the close position.

In the rotation process in the arrow E direction, at the rotation position P1, the contact part 53R of the top cover 141 becomes in contact with the receiving part 67R of the ejection cover 61 in the rotation position Q1 (the open position), and thereafter, the ejection cover 61 rotates in the arrow C direction against the biasing force thereof.

Here, the relation between the contact part 53R of the top cover 141 and the receiving part 67R of the ejection cover 61 is described. However, the contact part 53L of the top cover 141 and the receiving part 67L of the ejection cover 61, which are the other sides of the pairs, are configured to have a similar relation and similarly interact with each other.

Figure 28:
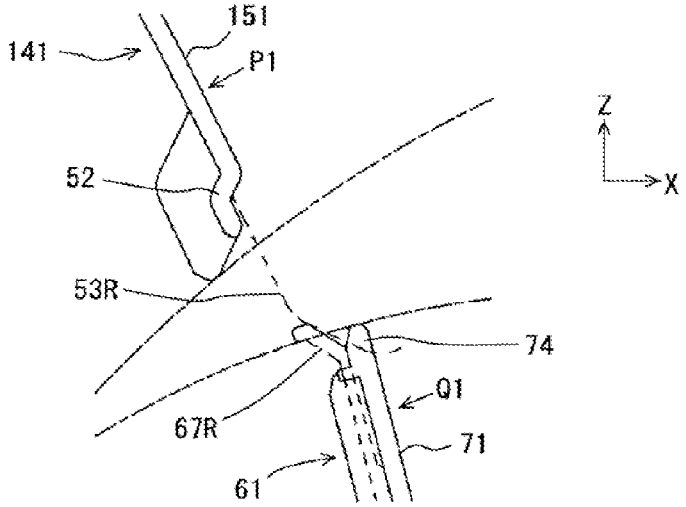
FIG. 28 illustrates an operation explanatory diagram illustrating a relation between a shaft side end part of the top cover and a front end part of the ejection cover when the top cover and the ejection cover are respectively in rotation positions P1, Q1, in the second embodiment.

FIG. 28 illustrates an operation explanatory diagram illustrating a relation between the shaft side end part 152 of the top cover 141 and the front end part 74 of the ejection cover 61 when the top cover 141 and the ejection cover 61 are respectively in the rotation positions P1, Q1.

As illustrated in FIG. 28, at the stage where the contact part 53 of the top cover 141 and the receiving part 67 of the ejection cover 61 begin to be in contact with each other, the shaft side end part 152 of the sheet placing surface 151 of the top cover 141 and the front end part 74 of the sheet placing surface 71 of the ejection cover 61 are still in a separated state.

Figure 29A:
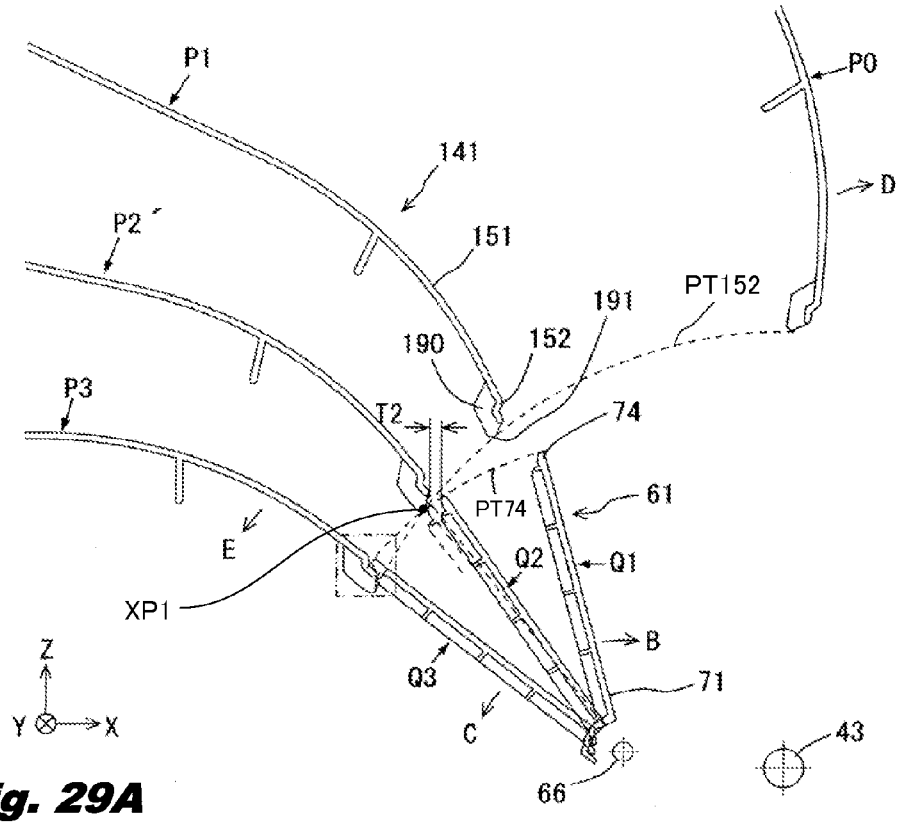
FIG. 29A illustrates an operation explanatory diagram illustrating a state viewed from the minus side of the Y-axis in which the shaft side end part of the top cover and the front end part of the ejection cover oppose (engage) each other during the process in which the top cover is closed, in the second embodiment.

FIG. 29A illustrates an operation explanatory diagram illustrating a state viewed from the minus side of the Y-axis in which the shaft side end part 152 of the sheet placing surface 151 of the top cover 41 and the front end part 74 of the sheet placing surface 71 of the ejection cover 61 oppose (engage) each other during the process in which the top cover 141 is closed. FIG. 29A illustrates, using solid lines, respective states of the top cover 141 at four places from the rotation position P0, which is the open position, to the rotation position P3, which is the close position, when the top cover 141 rotates in the directions of the arrows D, E about the supporting point part 43 (equivalent to a rotation shaft).

Figure 29B:
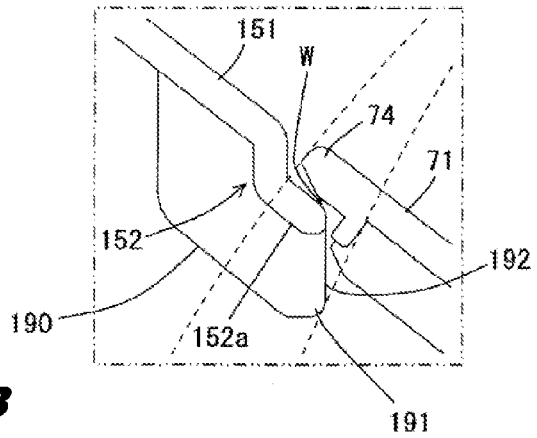
FIG. 29B illustrates a partial enlarged view of a rectangular surrounding portion in FIG. 29A.

FIG. 29A also illustrates, using solid lines, respective states of the ejection cover 61 at three places from the rotation position Q1 at the open position to the rotation position Q3 at the close position, when the ejection cover 61 rotates in the directions of the arrows B, C about the posts 66 (equivalent to a rotation shaft). The rotation positions P0-P3, Q1-Q3 are common to the respective rotation positions indicated using the same reference numeral symbols illustrated in FIG. 16. FIG. 29B illustrates a partial enlarged view of a rectangular surrounding portion in FIG. 29A.

In FIG. 29A, a movement path PH152 is a movement path of a front end part 191 of the guide rib 190 that is formed on the shaft side end part 152 of the sheet placing surface 151 of the top cover 141, and the movement path PT74 is the movement path of the front end part 74 of the sheet placing surface 71 of the ejection cover 61. In the embodiment, the shaft side end part 152 may be considered as a first engagement part of the invention, and the front end part 191 of the guide rib 190 may be defined as a part of the side end part 152, corresponding to the first engagement part. As described above, in the process in which the top cover 141 rotates from the open position in the arrow E direction, the contact part 53 of the top cover 141 engages with the receiving part 67 of the ejection cover 61 at the rotation position P1, and thereafter, along with the rotation of the top cover 141 in the arrow E direction, the ejection cover 61 rotates in the arrow C direction. The contact part 53 corresponds to a first contact part, and the receiving part 67 corresponds to a second contact part.

Here, conditions for forming the shaft side end part 152 of the top cover 141 are the same as conditions for forming the shaft side end part 52 of the top cover 41 of the first embodiment. As illustrated in FIGS. 26, 29A and 29B, the guide rib 190 is a plate-shaped member that is provided on the shaft side end part 152 is on a side of the arrow E direction (direction in which the top cover 141 is closed) of the shaft side end part 152 of the top cover 141 and extends in the same direction. The front end part 191 of the guide rib 190 is arranged closer to the supporting point part 43 than a front end part of a bent part 152*a* is, and a linear guide side 192 is formed from the front end part of the bent part 152*a* to the front end part 191.

The rotation position P2' is a rotation position of the top cover 141 when the front end part 191 of the guide rib 190 of the top cover 141 reaches a cross point of the movement paths PT152, PT74. As the movement paths PT152, PT74 illustrate, the front end part 191 of the guide rib 190 of the top cover 141 moves on an outer side of an arc of the movement path PT74 of the front end part 74 of the sheet placing surface 71 until the top cover 141 reaches the rotation position P2', and, after passing the rotation position P2', moves on an inner side of the arc of the movement path PT74 until reaching the rotation position P3 (close position). The cross point means an intersection formed by two front ends of the top cover 141 and the ejection cover 61. In this view, the cross point in FIG. 29A can be considered as a first cross point (XP1).

The configuration is provided in such a manner that, in the process in which the top cover 141 is closed, the bent part 152*a* of the shaft side end part 152 of the top cover 141 reaches the cross point of the movement paths PT152, PT74 first, and thereafter, the front end part 74 of the sheet placing surface 71 of the ejection cover 61 reaches the cross point. A clearance between the bent part 152*a* and the front end part 74 that occurs at the stage where the front end part 191 of the guide rib 190 reaches the rotation position P2' first is T2. Further, in this case, the sheet placing surface 151 of the top cover 141 and the sheet placing surface 71 of the ejection cover 61 are substantially flush with each other.

Therefore, as illustrated in FIG. 29B, a cross section of the shaft side end part 152 of the top cover 141 has a crank-like step part with respect to the sheet placing surface 151. The bent part 152*a* of the shaft side end part 152 is displaced toward a downstream side in the direction in which the top cover 141 is closed (in the arrow E direction), with respect to the sheet placing surface 151 and further, as illustrated in FIG. 28, with respect to the contact part 53, and extends toward the supporting point part 43 (equivalent to the rotation shaft). On the other hand, as illustrated in FIG. 28, the front end part 74 as a second engagement part of the sheet placing surface 71 of the ejection cover 61 is positioned on an upstream side in the direction in which the ejection cover 61 is closed (in the arrow B direction), with respect to the receiving part 67.

When the top cover 141 further rotates from the rotation position P2' in the arrow E direction, first the guide rib 190 of the top cover 141, followed by the bent part 152*a* of the top cover 141, and the front end part 71 of the ejection cover 61 that is positioned on a more upstream side (the arrow B direction) in the direction in which the ejection cover 61 is closed than the guide rib 190 and the bent part 152*a*, begin to sequentially overlap in a tangential direction of the arc of the movement path PT74 of the front end part 74 of the sheet placing surface 71. At the stage where the top cover 141 reaches the rotation position P3, which is the close position, as illustrated in FIG. 29B, the bent part 152*a* of the top cover 141 and the front end part 71 of the ejection cover 61 are formed in such a manner that the bent part 152*a* and the front end part 71 overlap for a required amount and oppose (engage) each other across a gap w.

Here, when the above-described rotation position P2 of the first embodiment that is illustrated in FIG. 18A and the rotation position P2' of the present embodiment are compared, as illustrated in FIG. 29A, the rotation position P2' is moved to the arrow D side of the rotation position P2 by an amount by which the front end part 191 of the guide rib 190 is arranged closer to the supporting point part 43 than the front end part of the bent part 152*a*.

Therefore, a clearance T2 between the bent part 152*a* and the front end part 74 at the rotation position P2' of the top cover 141 is ensured to be larger than the above-described clearance T1 between the bent part 52*a* and the front end part 74 in the first embodiment that is illustrated in FIG. 18B. Here, the clearance is a measure of allowance when the front end part 74 of the ejection cover 61 is displaced in the arrow C direction (direction in which the ejection cover 61 is closed), for example, as illustrated by dotted lines in FIG. 29A, due to warping or deformation. The larger the clearance is, the more the allowance increases.

For example, even when the ejection cover 61 is deformed as illustrated by the dotted lines in FIG. 29A, in the process in which the top cover 141 further rotates from the rotation position P2' in the arrow E direction, the front end part 74 of the ejection cover 61 becomes in contact with the linear guide side 192 of the guide rib 190 and is guided to the bent part 152*a* of the top cover 141. At the stage where the top cover 141 reaches the rotation position P3, which corresponds to the close position of the top cover unit 140, the front end part 74 of the ejection cover 61 remains at the rotation position Q3 in a state in which the deformation is corrected. Thus, the front end part 74 of the ejection cover 61 can be prevented from being positioned more on the arrow C side than the shaft side end part 152 of the top cover 141.

When the top cover 141 reaches the rotation position P3, the top cover unit 140 is in the close position and, as described above, is locked at this close position by fitting the claw part 47 of the lock bar 46 (FIG. 10) provided on the front cover 45 into the opening part 44 of the inner plate 42. On the other hand, as illustrated in FIG. 27, the ejection cover 61 remains at the rotation position Q3, which is the close position, in a state in which the receiving part 67 of the ejection cover 61 presses against the contact part 53 of the top cover 141, by the biasing force due to the torsion spring 68 (FIG. 13).

On the other hand, in the state in which the ejection cover 61 is in the close position, when the ejection cover 61 is subjected to, for example, a force F in a downward direction (the arrow C direction illustrated in FIG. 27) as illustrated by an arrow F as illustrated in FIG. 11, the ejection cover 61 tends to rotate in the same direction against the biasing force. However, as illustrated in FIGS. 29A and 29B, the front end part 74 of the ejection cover 61 is in contact with the bent part 152*a* of the shaft side end part 152 of the top cover 141 and the rotation in the same direction is inhibited. As a result, even when the ejection cover 61 is subjected to an external force, the state in which the sheet placing surface 151 of the top cover 141 and the sheet placing surface 71 of the ejection cover 61 are flush with each other is maintained.

As described above, according to the cover opening and closing mechanism of the present embodiment, when the top cover 141 is in the close position in which the top cover 141 is closed, the front end part 74 of the ejection cover 61 is positioned on a more upstream side (the arrow B direction) in the direction in which the ejection cover 61 is closed than the bent part 152*a* of the shaft side end part 152 of the top cover 141. Therefore, even when an external force is applied to the front end part 74 of the ejection cover 61, rotation is restricted by the bent part 152*a* of the top cover 141, so that a gap does not occur between the overlapping portions and a good appearance is obtained.

Further, even in the state in which front end part 74 of the ejection cover 61 is deformed in the direction in which the ejection cover 61 is closed due to warping or deformation, since the top cover unit 140 is closed while the front end part 74 is in contact with the guide side 192 of the guide rib 190, the opening and closing operation of the top cover unit 140 becomes more smooth.

In the above-described embodiments, examples are described in which the present invention is applied to an image forming apparatus as a printer. However, the present invention is not limited to this, but can also be applied to image forming apparatuses such as a copying machine and a facsimile, and further to apparatuses in other fields.

Additional Descriptions

In this application, front ends often mean distal ends that are positioned at the farthest portions from rotational axes.

Specs, Preferred Ranges and Formulas of Embodiment

In this section, specs and preferred ranges of the specs are described. As shown FIG. 16A, the first engagement path (PT52) of the first engagement part (52) has first engagement radius R52 around the first rotation point (43). The second engagement path (PT74) of the second engagement part (74) has second engagement radius R74. FIG. 16A illustrates that the first contact path (PT53) of the first contact part (53) has first contact radius R53 and the second contact path (PT67) of the second contact part (67) has second contact radius R67, both of which swing around the second rotation point (66). The distances between the two rotation points (43 and 66) are referred with Lx in X direction and Lz in Z direction. Lx and Lz are respectively horizontal and vertical in FIG. 18A. The direct distance is referred by L0 shown in FIG. 18D.

The first engagement path (PT52, PT152) and the second engagement path (PT74) intersect. The point is defined as a first cross point (XP1). The first cross point may be defined as a point where a distal end of the first sheet placing surface (51) comes to contact to the second sheet placing surface (71). Without a guide rib, the first cross point is illustrated in FIG. 18B. With a guide rib, the first cross point is illustrated in FIG. 29A.

Regarding the first and second contact parts (53, 67), the first contact path (PT53) and the second contact path (PT67) intersect. The point is defined as a second cross point (XP2). The second cross point may be defined as a point where a distal end of any part other than the second sheet placing surface (71) comes to contact to any part other than the first sheet placing surface (71).

The contact lengths between the first contact part and the second contact part are referred by d1 to d3 according to the positions, see FIG. 16B. Rotation angles of the first engagement part (52) are referred by θ1 and θ2. Rotation angle θ1 corresponds to an angle that is measured from open position P1 to middle P2. Rotation angle θ2 corresponds to an angle that is measured from middle position P2 to close position P3. Rotation angles of the second engagement part (74) are referred by θ3 and θ4. Rotation angle θ3 corresponds to an angle that is measured from open position P1 to middle P2. Rotation angle θ4 corresponds to an angle that is measured from middle position P2 to close position P3.

A first height difference (H1) is defined as a height gap between the first engagement path (PT52) and the second engagement path (PT74). The gap is measured on a vertical line (VL) passing through the second rotation point (66), see FIG. 18D A second height difference (H2) is defined as another height gap between the first contact path (PT53) and the second contact path (PT67). The gap is measured on a vertical line (VL) passing through the second rotation point (66), see FIG. 16B.

=As one example, actual specs of the above elements are shown below.

R52=137 mm, R74=96 mm, R53=118 mm, R67=94 mm

Lz=5.2 mm, Lx=48.6 mm, L0=48.9 mm d1=5.5 mm, d2=6.5 mm, d3=10 mm

θ1=18°, θ2=7°, θ3=27°, θ4=10°.

In order to compact the mechanism, it is preferred that the first rotation point is positioned above the second rotation point in Z-direction (or vertical direction). Also, the radius R67 is preferably smaller than the radius R53.

In order that a rotation load of the second cover member (61) is less likely to affect a rotation load of the first cover member (41) at a timing of the second contact part (67)'s contact to the first contact part (53), it is preferred that length Lx is less than radius R53. Also, first height difference H1 is greater than zero.

In order to intersect the first and second embodiment paths (PT52, PT74), it is preferred to satisfy the formula below:

$R67>R53-L0$, and $R74<R52<R53$.

In order to obtain a space for engagements, it is preferred to satisfy the formulas below:

$H1>H2$, $\theta3>\theta4$, $\theta1>\theta2$.

Further, length Lx is preferably ranged within 30% to 70% of radius R53. Length Lz is preferably ranged within 5% to 30% of length Lx. Radius R67 is preferably ranged within 60% to 90% of radius R53. Radius R74 is preferably ranged within 60% to 91% of radius R52.

What is claimed is:

1. A cover opening and closing mechanism, comprising:

a first cover member that is a part of a housing and swings between an open position and a close position about a first rotation point; having a first sheet placing surface, a direction from the open position to the close position being defined as a close direction, and a second cover member that swings about a second rotation point in conjunction with a movement of the first cover member, having a second sheet placing surface, wherein the first cover member has a first engagement part at a distal end of the first sheet placing surface, the second cover member has a second engagement part, which engages with the first engagement part when the first cover member is positioned at the close position, at a distal end of the second sheet placing surface so that the first sheet placing surface is flush with the second sheet placing surface, during a process in which the first cover member swings in the close direction, a first contact part of the first cover member, which is other than the first sheet placing surface, contacts to a second contact part of the second cover member, which is other than the second sheet placing surface, before the first engagement part contacts to the second engagement part, seen from a axial direction of the first rotation point, a moving path of the first engagement part is defined as a first engagement path, a moving path of the second engagement part is defined as a second engagement path, the first engagement path and the second engagement path are arranged to intersect at a first cross point, and the first cross point is located at a downstream in the close direction from a second cross point where the first contact part contacts to the second contact part.

2. The cover opening and closing mechanism according to claim 1, wherein during the process in which the first cover member swings in the close direction, the second contact part contacts to the first contact part when the first cover member is in the open position, and swings in conjunction with the first contact part keeping the contact with the contact part until the first cover member reaches the close position.

3. The cover opening and closing mechanism according to claim 1, wherein during the process in which the first cover member swings from the open position to the close position, the first engagement path comes to the first cross point from outside to inside with respect to the second engagement path in the close direction.

4. The cover opening and closing mechanism according to claim 1, wherein the first rotation point and the second rotation point are separately arranged with a predetermined distance.

5. The cover opening and closing mechanism according to claim 1, wherein during the process in which the first cover member swings in the close direction, after the first cover member passes through the first cross point, the first engagement part and the second engagement part overlap in a tangential direction of the second engagement path.

6. The cover opening and closing mechanism according to claim 1, wherein the first cover member has an opening of which a portion of an edge is formed by the first engagement part, and the first engagement part is positioned on a side farther than the opening from the first rotation point and extends in an axial direction of the first rotation point.

7. The cover opening and closing mechanism according to claim 6, wherein the second cover member swings between an open position and a close position, the second cover member shields the opening of the first cover member when the second cover member is at the close position.

8. The cover opening and closing mechanism according to claim 7, further comprising:

a biasing member that generates a biasing force, wherein the second cover member is biased by the biasing member toward the open position when the second cover member is at the close position.

9. The cover opening and closing mechanism according to claim 1, wherein the first cover member is provided with a guide rib that is positioned on a downstream from the first engagement part in the close direction and of which a front end part is arranged closer than the first engagement part to the first rotation point, and a guide side is provided between the front end part of the guide rib and a front end part of the first engagement part.

10. An image forming apparatus, comprising:

the cover opening and closing mechanism according to claim 1.

11. The cover opening and closing mechanism according to claim 1, wherein a point where the first and second engagement paths intersect is defined as an intersection point, wherein during a process in which both of the first and second cover members swing in a close direction, and when the first engagement part is positioned at an upstream from the intersection point in the close direction of the first engagement path and the second engagement part is positioned at an upstream from the intersection point in the close direction of the second engagement path, the first cover member starts to contact the second cover member, after contacting, the first and second cover members start to swing in conjunction each other, and the first and second engagement parts engage at a downstream from the intersection point.

12. A cover opening and closing mechanism, comprising:

a first cover member that is a part of a housing and swings between an open position and a close position about a first rotation point; having a first sheet placing surface, a direction from the open position to the close position being defined as a close direction, and a second cover member that swings about a second rotation point in conjunction with a movement of the first cover member, having a second sheet placing surface, wherein the first cover member has a first engagement part at a distal end of the first sheet placing surface, the second cover member has a second engagement part, which engages with the first engagement part when the first cover member is positioned at the close position, at a distal end of the second sheet placing surface so that the first sheet placing surface is flush with the second sheet placing surface, during a process in which the first cover member swings in the close direction, a first contact part of the first cover member, which is other than the first sheet placing surface, contacts to a second contact part of the second cover member, which is other than the second sheet placing surface, before the first engagement part contacts to the second engagement part, the first engagement part is provided with a guide rib that is at a distal end thereof, extends toward the downstream and the first rotation point, seen from a axial direction of the first rotation point, a moving path of a front end of the guide rib is defined as a third engagement path, a moving path of the second engagement part is defined as a second engagement path, the third engagement path and the second engagement path are arranged to intersect at a first cross point, and the first cross point is located at a downstream in the close direction from a second cross point where the first contact part contacts to the second contact part.

13. The cover opening and closing mechanism according to claim 12, wherein during the process in which the first cover member swings in the close direction, the second contact part contacts to the first contact part when the first cover member is in the open position, and swings in conjunction with the first contact part keeping the contact with the contact part until the first cover member reaches the close position.

14. The cover opening and closing mechanism according to claim 12, wherein the first rotation point and the second rotation point are separately arranged with a predetermined distance.

15. The cover opening and closing mechanism according to claim 12, wherein a moving path of the first engagement part is defined as a first engagement path, and a point where the first and second engagement paths intersect is defined as an intersection point, wherein during a process in which both of the first and second cover members swing in a close direction, and when the first engagement part is positioned at an upstream from the intersection point in the close direction of the first engagement path and the second engagement part is positioned at an upstream from the intersection point in the close direction of the second engagement path, the first cover member starts to contact the second cover member, after contacting, the first and second cover members start to swing in conjunction each other, and the first and second engagement parts engage at a downstream from the intersection point.

16. A cover opening and closing mechanism for a printer, comprising:

a first cover member that is a part of a housing and swings between an open position and a close position about a first rotation point, a direction from the open position to the close position being defined as a close direction, the first cover member having, in an axial direction of the first rotation point, a first sheet placing surface arranged at a middle and a first contact part arranged at one of side ends of the first sheet placing surface, and the first sheet placing surface having a first engagement part at a distal end of the first sheet placing surface, a second cover member that swings between an open position and a close position about a second rotation point, a direction from the open position to the close position being defined as a close direction, the second cover member having, in the axial direction, a second sheet placing surface arranged at a middle and a second contact part arranged at one of side ends of the second sheet placing surface, and the second sheet placing surface having a second engagement part, which engages with the first engagement part when the first cover member is positioned at the close position, at a distal end of the second sheet placing surface so that the first sheet placing surface is flush with the second sheet placing surface for stacking sheets, and seen from the axial direction, moving paths of the first engagement part and the first contact part are respectively defined as a first engagement path and a first contact path, both of which swinging about the first rotation point, moving paths of the second engagement part and the second contact part are respectively defined as a second engagement path and a second contact path, both of which swinging about the second rotation supporting point, the first engagement path and the second engagement path intersect at a first cross point, and the first contact path and the second contact path intersect at a second cross point, wherein in the close direction, the first cross point is at a downstream from the second cross point so that the first contact part of the first cover member contacts to the second contact part of the second cover member before the first engagement part contacts to the second engagement part.

17. The cover opening and closing mechanism of claim 16, wherein the first contact part and the second contact part keep in contact by sliding each other as moving toward the close position after contacting, contact lengths between the first contact part and the second contact part increase during the moving.

18. The cover opening and closing mechanism of claim 16, wherein the first cover member has another first contact part, which is symmetrically identical to the first contact part, at the other of the side ends of the first sheet placing surface, the second cover member has another second contact part, which is symmetrically identical to the second contact part and corresponds to the another first contact part, at the other of the side ends of the second sheet placing surface.

19. The cover opening and closing mechanism of claim 16, wherein the first engagement path has a first engagement radius (R52), the second engagement path has a second engagement radius (R74), the first contact path has a first contact radius (R53), the second contact path has a second contact radius (R67), the first rotation point is separated from the second rotation point with a distance (L0), the following formulas are satisfied:

$$(R53-L0)<R67<R53$$

$$R74<R52<R53.$$

20. The cover opening and closing mechanism of claim 16, wherein a first height difference (H1) between the first engagement path and the second engagement path is measured on a vertical line passing through the second rotation point, a second height difference (H2) between the first contact path and the second contact path is measured on the vertical line, the following formula is satisfied:

$$0<H2<H1.$$

* * * * *